US009962979B2

(12) United States Patent
Will et al.

(10) Patent No.: US 9,962,979 B2
(45) Date of Patent: May 8, 2018

(54) SEMI-AUTOMATED SUBLIMATION PRINTING APPARATUS

(71) Applicant: The Hillman Group, Inc., Cincinnati, OH (US)

(72) Inventors: Gary Edward Will, Gold Canyon, AZ (US); Byron Keith Grice, Phoenix, AZ (US); Brian David Rosner, Phoenix, AZ (US)

(73) Assignee: The Hillman Group, Inc., Cincinnati, OH (US)

( * ) Notice: Subject to any disclaimer, the term of this patent is extended or adjusted under 35 U.S.C. 154(b) by 0 days. days.

(21) Appl. No.: 15/227,775

(22) Filed: Aug. 3, 2016

(65) Prior Publication Data

US 2017/0036472 A1 Feb. 9, 2017

Related U.S. Application Data

(60) Provisional application No. 62/201,355, filed on Aug. 5, 2015.

(51) Int. Cl.
*B41J 11/02* (2006.01)
*B41F 16/00* (2006.01)
(Continued)

(52) U.S. Cl.
CPC ..... *B41M 5/0256* (2013.01); *B41F 16/00* (2013.01); *B41M 5/0358* (2013.01)

(58) Field of Classification Search
CPC ... B41J 2/0057; B41J 2/22; B41J 2/315; B41J 2/325; B41J 2002/012; B41J 11/02;
(Continued)

(56) References Cited

U.S. PATENT DOCUMENTS 4,059,471 A 11/1977 Haigh
4,174,250 A 11/1979 Durand
(Continued)

FOREIGN PATENT DOCUMENTS

DE 10 1011 012833 A1 9/2012
EP 2000303 10/2008
(Continued)

OTHER PUBLICATIONS

European Patent Office, Internationai Search Report for PCT Application No. PCT/US2014/047527, dated Feb. 12, 2016, 3 pages.
(Continued)

*Primary Examiner* — Geoffrey Mruk
*Assistant Examiner* — Scott A Richmond
(74) *Attorney, Agent, or Firm* — Finnegan, Henderson, Farabow, Garrett & Dunner LLP

(57) ABSTRACT

A dye sublimation apparatus is disclosed. The apparatus is configured to either print one or more images onto transfer media, or to print images directly onto products. A selected product to receive the image(s) is positioned on a platen configured to receive one or more types of such products into channels matching those products' dimensions. Proper positioning of the transfer media (or the product, when directly printed) is facilitated by aligning fiducial markers printed on the transfer media and/or product with one or more lights disposed on the platen. The apparatus comprises one or more heating platens configured to sublimate one or more sides of the product in a single thermal cycle with a predetermined temperature, pressure, and duration based on properties of the product. The product platen is translated inside and out of the apparatus by a reversible motor.

11 Claims, 24 Drawing Sheets

(51) Int. Cl.
*B41M 5/025* (2006.01)
*B41M 5/035* (2006.01)

(58) Field of Classification Search
CPC ..... B41J 11/04; B41J 11/053; B41J 11/057; B41J 13/02; B41M 5/0256; B41M 5/0358; B41F 16/00
See application file for complete search history.

(56) References Cited

U.S. PATENT DOCUMENTS 4,202,663 A 5/1980 Haigh et al.
4,242,092 A 12/1980 Glover
4,253,838 A 3/1981 Mizuno et al.
4,314,814 A 2/1982 Deroode
4,412,292 A 10/1983 Sedam et al.
4,465,728 A 8/1984 Haigh et al.
4,662,966 A 5/1987 Sumi et al.
4,664,672 A 5/1987 Krajec et al.
4,670,084 A 6/1987 Durand
4,873,643 A 10/1989 Powell et al.
4,933,315 A 6/1990 Kanto et al.
4,943,555 A 7/1990 Nakamoto et al.
4,990,485 A 2/1991 Egashira et al.
5,122,499 A 6/1992 Janssens et al.
5,135,905 A 8/1992 Egashira et al.
5,202,176 A 4/1993 Higuchi et al.
5,244,234 A 9/1993 Oshima et al.
5,246,518 A 9/1993 Hale
5,248,363 A 9/1993 Hale
5,252,530 A 10/1993 Nakamura
5,254,523 A 10/1993 Fujimura et al.
5,302,223 A 4/1994 Hale
5,308,426 A 5/1994 Claveau
5,344,807 A 9/1994 Nakamura
5,346,877 A 9/1994 Nakamura
5,354,401 A 10/1994 Asahi et al.
5,431,501 A 7/1995 Hale et al.
5,432,145 A 7/1995 Oshima et al.
5,468,714 A 11/1995 Oshima et al.
5,487,614 A 1/1996 Hale
5,488,907 A 2/1996 Xu et al.
5,513,116 A 4/1996 Buckley et al.
5,522,317 A 6/1996 Hale et al.
5,546,316 A 8/1996 Buckley et al.
5,550,098 A 8/1996 Aso et al.
5,555,813 A 9/1996 Hale et al.
5,559,714 A 9/1996 Banks et al.
5,574,829 A 11/1996 Wallace et al.
5,575,877 A 11/1996 Hale et al.
5,580,410 A 12/1996 Johnston
5,590,600 A 1/1997 Hale et al.
5,601,023 A 2/1997 Hale et al.
5,615,123 A 3/1997 Davidson et al.
5,623,581 A 4/1997 Attenberg
5,630,894 A 5/1997 Koch et al.
5,634,731 A 6/1997 Kita et al.
5,640,180 A 6/1997 Hale et al.
5,642,141 A 6/1997 Hale et al.
5,643,387 A 7/1997 Berghauser et al.
5,644,988 A 7/1997 Xu et al.
5,710,887 A 1/1998 Chelliah et al.
5,734,396 A 3/1998 Hale et al.
5,822,423 A 10/1998 Jehnert et al.
5,830,263 A 11/1998 Hale et al.
5,959,278 A 9/1999 Kobayashi et al.
5,962,368 A 10/1999 Poole
5,997,677 A 12/1999 Zaher
6,038,491 A 3/2000 McGarry et al.
6,085,126 A 7/2000 Mellgren, III et al.
6,103,041 A 8/2000 Wagner et al.
6,105,502 A 8/2000 Wagner et al.
6,110,316 A 8/2000 Kobayashi et al.
6,118,545 A 9/2000 Kawai et al.
6,149,754 A 11/2000 Ogata et al.
6,165,938 A 12/2000 Narita et al.
6,186,207 B1 2/2001 Berghauser et al.
6,249,297 B1 6/2001 Lion
6,298,685 B1 10/2001 Tepman
6,339,731 B1 1/2002 Morris et al.
6,341,856 B1 1/2002 Thompson et al.
6,344,103 B1 2/2002 Cheng et al.
6,348,939 B1 2/2002 Xu et al.
6,392,680 B2 5/2002 Akada et al.
6,402,313 B1 6/2002 Xu et al.
6,425,331 B1 7/2002 Xu et al.
6,439,710 B1 8/2002 Hale et al.
6,447,629 B1 9/2002 Thompson et al.
6,450,098 B1 9/2002 Hale et al.
6,474,230 B2 11/2002 Corrado
6,486,903 B1 11/2002 Wagner et al.
6,488,370 B2 12/2002 Hale et al.
6,505,095 B1 1/2003 Kolls
6,535,294 B1 3/2003 Arledge, Jr. et al.
6,535,791 B1 3/2003 Wang
6,540,345 B1 4/2003 Wagner et al.
6,587,839 B1 7/2003 McIntyre et al.
6,594,642 B1 7/2003 Lemchen
6,606,602 B1 8/2003 Kolls
6,618,066 B2 9/2003 Hale et al.
6,623,677 B1 9/2003 Smith et al.
6,631,984 B2 10/2003 Thompson et al.
RE38,295 E 11/2003 Kobayashi et al.
6,649,317 B2 11/2003 Wagner et al.
6,673,503 B2 1/2004 Wagner et al.
6,681,151 B1 1/2004 Weinzimmer et al.
6,686,314 B2 2/2004 Xu et al.
6,718,237 B1 4/2004 Murray et al.
6,814,831 B2 11/2004 Drake
6,816,752 B1 11/2004 Wang
6,840,614 B2 1/2005 Wagner et al.
6,849,370 B2 2/2005 Wagner et al.
6,887,640 B2 5/2005 Zhang et al.
6,915,273 B1 7/2005 Parulski
6,941,276 B2 9/2005 Haeberli
6,957,125 B1 10/2005 Rifkin
6,961,076 B2 11/2005 Wagner et al.
6,966,643 B2 11/2005 Hale et al.
RE38,952 E 1/2006 Hale et al.
6,998,005 B2 2/2006 Magee et al.
7,001,649 B2 2/2006 Wagner et al.
7,041,424 B2 5/2006 Xu et al.
7,137,426 B2 11/2006 Neri et al.
7,154,630 B1 12/2006 Nimura et al.
7,156,566 B2 1/2007 Johnson et al.
7,166,191 B2 1/2007 Suzuki et al.
7,167,892 B2 1/2007 Defosse et al.
7,212,308 B2 5/2007 Morgan
7,218,991 B2 5/2007 Walker et al.
7,267,737 B2 9/2007 Neri et al.
7,337,130 B2 2/2008 Ito et al.
7,524,048 B2 4/2009 Xu
7,527,655 B1 5/2009 Wagner et al.
7,563,341 B2 7/2009 Ferguson et al.
7,593,897 B1 9/2009 Kolls
7,654,660 B2 2/2010 Hale et al.
7,810,538 B2 10/2010 Magee et al.
7,870,824 B2 1/2011 Helma et al.
7,880,599 B2 2/2011 Murray et al.
8,024,231 B2 9/2011 Taratino et al.
8,029,883 B2 10/2011 Xu et al.
8,060,247 B2 11/2011 Kaplan et al.
8,191,779 B2 6/2012 Illingworth et al.
8,214,247 B2 7/2012 Murray et al.
8,253,549 B2 8/2012 Murray et al.
8,265,605 B2 9/2012 Marett et al.
8,268,546 B2 9/2012 Kobayashi et al.
8,283,290 B2 10/2012 Langan et al.
8,308,891 B2 11/2012 Drake et al.
8,337,006 B2 12/2012 Hale et al.
8,343,574 B2 1/2013 Downs et al.
8,349,114 B2 1/2013 Green
8,373,558 B2 2/2013 Sagady et al.
8,387,673 B2 3/2013 Spengler

(56) References Cited

U.S. PATENT DOCUMENTS

| | | | | |
|---|---|---|---|---|
| 8,392,279 | B2 | 3/2013 | Reichhart | |
| 8,398,224 | B2 | 3/2013 | Hale et al. | |
| 8,400,485 | B2 | 3/2013 | Hirota | |
| 8,405,694 | B2 | 3/2013 | Hsu et al. | |
| 8,425,029 | B2 | 4/2013 | Xu | |
| 8,509,944 | B1 | 8/2013 | Kranyec | |
| 8,626,614 | B2 | 1/2014 | Barber et al. | |
| 8,688,764 | B2 | 4/2014 | Chauvin et al. | |
| 8,731,703 | B1 | 5/2014 | Lehrer et al. | |
| 9,120,326 | B2 | 9/2015 | Will et al. | |
| 9,333,788 | B2 | 5/2016 | Will et al. | |
| 9,403,394 | B2 | 8/2016 | Will et al. | |
| 9,446,599 | B2 | 9/2016 | Will et al. | |
| 9,545,808 | B2 | 1/2017 | Rosner et al. | |
| 2001/0049636 | A1 | 12/2001 | Hudda et al. | |
| 2001/0051876 | A1 | 12/2001 | Seigel et al. | |
| 2002/0040374 | A1 | 4/2002 | Kent | |
| 2002/0066378 | A1 | 6/2002 | Almblad et al. | |
| 2002/0103034 | A1 | 8/2002 | Kammerer et al. | |
| 2002/0126132 | A1 | 9/2002 | Karatassos | |
| 2002/0186290 | A1* | 12/2002 | Ogasawara | B41J 2/0057 347/103 |
| 2002/0186402 | A1 | 12/2002 | Jackson et al. | |
| 2003/0033054 | A1 | 2/2003 | Yamazaki | |
| 2003/0086123 | A1 | 5/2003 | Torrens-Burton | |
| 2003/0140017 | A1 | 7/2003 | Patton et al. | |
| 2004/0050279 | A1 | 3/2004 | Ibarra et al. | |
| 2004/0143914 | A1 | 7/2004 | Flaherty | |
| 2004/0165218 | A1 | 8/2004 | Fredlund et al. | |
| 2004/0170415 | A1 | 9/2004 | Maeda et al. | |
| 2004/0172325 | A1 | 9/2004 | Blanco et al. | |
| 2005/0043011 | A1 | 2/2005 | Murray et al. | |
| 2005/0070434 | A1 | 3/2005 | Drake | |
| 2005/0150591 | A1 | 7/2005 | Goertzen | |
| 2005/0182649 | A1 | 8/2005 | Parulski | |
| 2005/0212843 | A1* | 9/2005 | Jones | B41J 2/0057 347/19 |
| 2005/0248649 | A1 | 11/2005 | Farrell et al. | |
| 2005/0275870 | A1 | 12/2005 | Elarde et al. | |
| 2006/0031128 | A1 | 2/2006 | Lamitie | |
| 2006/0159851 | A1 | 7/2006 | Tomasella et al. | |
| 2007/0136125 | A1 | 6/2007 | Godwin et al. | |
| 2007/0164554 | A1 | 7/2007 | Krone et al. | |
| 2007/0181253 | A1 | 8/2007 | Xu et al. | |
| 2007/0213216 | A1 | 9/2007 | Lindemann et al. | |
| 2008/0095940 | A1 | 4/2008 | Lee et al. | |
| 2008/0213027 | A1* | 9/2008 | Yraceburu | B41J 11/0085 400/648 |
| 2008/0249657 | A1 | 9/2008 | Wendland et al. | |
| 2010/0007896 | A1 | 1/2010 | Fishbaine | |
| 2010/0129621 | A1 | 5/2010 | Langan et al. | |
| 2010/0266817 | A1 | 10/2010 | Hirst | |
| 2010/0277758 | A1 | 11/2010 | Reichhart | |
| 2011/0111188 | A1 | 5/2011 | Xu et al. | |
| 2011/0180202 | A1 | 7/2011 | Hirst et al. | |
| 2012/0001978 | A1* | 1/2012 | Burke | B41J 11/009 347/19 |
| 2012/0044312 | A1 | 2/2012 | Hirst | |
| 2012/0219652 | A1 | 8/2012 | Simons | |
| 2012/0297041 | A1 | 11/2012 | Momchilov | |
| 2012/0301122 | A1 | 11/2012 | Chao et al. | |
| 2012/0320136 | A1 | 12/2012 | Xu | |
| 2012/0327257 | A1 | 12/2012 | O'Keefe et al. | |
| 2013/0036018 | A1 | 2/2013 | Dickerson | |
| 2013/0045341 | A1 | 2/2013 | Ramsden | |
| 2014/0108188 | A1 | 4/2014 | Comstock et al. | |
| 2015/0028094 | A1* | 1/2015 | Will | B41M 5/382 235/3 |
| 2015/0029285 | A1 | 1/2015 | Will et al. | |
| 2015/0029288 | A1 | 1/2015 | Will et al. | |
| 2015/0029289 | A1* | 1/2015 | Rosner | B41F 16/0046 347/217 |
| 2015/0032528 | A1 | 1/2015 | Will et al. | |
| 2015/0310694 | A1 | 10/2015 | Will et al. | |
| 2015/0336395 | A1 | 11/2015 | Will et al. | |
| 2016/0031228 | A1 | 2/2016 | Will et al. | |
| 2016/0221354 | A1 | 8/2016 | Will et al. | |
| 2016/0311241 | A1 | 10/2016 | Rosner et al. | |

FOREIGN PATENT DOCUMENTS

| | | | |
|---|---|---|---|
| GB | 2 130 144 | A | 5/1984 |
| WO | WO 95/05609 | A2 | 2/1995 |
| WO | WO 96/006729 | A1 | 3/1996 |
| WO | WO 97/009180 | A1 | 3/1997 |
| WO | WO 99/48065 | A1 | 9/1999 |
| WO | WO 99/50801 | A2 | 10/1999 |
| WO | WO 00/007822 | A1 | 2/2000 |
| WO | WO 2005/0105470 | | 11/2005 |
| WO | WO 2008/0144839 | | 12/2008 |
| WO | WO 2009/053721 | A1 | 4/2009 |
| WO | WO 2011/0003125 | | 1/2011 |
| WO | WO 2011/0039785 | | 4/2011 |
| WO | WO 2012/141985 | A1 | 10/2012 |

OTHER PUBLICATIONS

European Patent Office, Written Opinion of the International Searching Authority for PCT Application No. PCT/US2014/047527, dated Feb. 12, 2015, 7 pages.

European Patent Office, International Search Report for PCT Application No. PCT/US2014/045719, dated Feb. 13, 2015, 3 pages.

European Patent Office, Written Opinion of the International Searching Authority for PCT Application No. PCT/US2014/045719, dated Feb. 13, 2015, 9 pages.

European Patent Office, International Search Report for PCT Application No. PCT/US2014/047142, dated Feb. 19, 2015, 3 pages.

European Patent Office, Written Opinion of the International Searching Authority for PCT Application No. PCT/US2014/047142, Feb. 19, 2015, 9 pages.

Office Action, U.S. Appl. No. 13/951,127, dated Mar. 17, 2015, 7 pages.

"Mug Sublimation," YouTube, http://www.youtube.com/watch?v=Xi DB3TVAws, uploaded Jan. 21, 2008.

European Patent Office, International Search Report for PCT Application No. PCT/US2014/047396, dated Dec. 16, 2014, 6 pages.

European Patent Office, Written Opinion of in the Internationai Searching Authority for PCT Application No. PCT/US2014/047396, dated Dec. 16, 2014, 7 pages.

European Patent Office, International Search Report for PCT Application No. PCT/US2014/046944, dated Dec. 15, 2014, 6 pages.

European Patent Office, Written Opinion of the International Searching Authority for PCT Application No. PCT/US2014/046944, dated Dec. 15, 2014, 9 pages.

Office Action, U.S. Appl. No. 13/951,150, dated Jun. 19, 2015, 9 pages.

Office Action, U.S. Appl. No. 13/951,150, dated Oct. 28, 2015, 10 pages.

Office Action, U.S. Appl. No. 14/261,202, dated Sep. 21, 2015, 18 pages.

Office Action, U.S. Appl. No. 15/093,170, dated Jun. 3, 2016, 9 pages.

Office Action, U.S. Appl. No. 14/818,896, dated Apr. 13, 2016, 11 pages.

Office Action, U.S. Appl. No. 14/815,439, dated Sep. 4, 2015, 10 pages.

* cited by examiner

SEMI-AUTOMATED SUBLIMATION PRINTING APPARATUS

FIELD

The present disclosure generally relates to dye sublimation printing, and more particularly, to a semi-automated clerk-operated or consumer-operated apparatus for sublimating an image on a product capable of incorporating sublimation dye.

BACKGROUND

Dye sublimation is a process employing heat and pressure to convert solid dyes into gaseous form without entering an intermediate liquid phase. Such a process can infuse colored dye into certain compatible materials, such as polyester or ceramics, to create a permanent printed image on the material.

Two primary types of dye sublimation printing systems exist in the marketplace. In a "direct" sublimation system, the printing system is configured to sublimate an image directly onto a compatible surface. Alternatively, in "transfer" systems, the images to be sublimated are first printed on an intermediate media, such as a coated paper or ribbon, and then transferred to a compatible surface using heat and pressure.

Integrated sublimation printing systems may be adaptable to various retail environments, either in fully-automated embodiments that can be safely operated by consumers with no previous training, or in semi-automated embodiments that can be operated by retail employees for specialized purposes. Several features are desirable in an integrated sublimation printing system designed for a retail environment. Sublimation systems deployed in a retail setting must strike several critical balances to achieve market success. The device must be capable of drawing enough power in order to apply the necessary sublimation temperature and pressure to a product, and must be able to ramp up the electrical current to do so on short notice. Additionally, the system must perform these tasks in a manner that is compatible with the existing electrical wiring configuration of the host retail establishment. Retail consumers are frequently unwilling to wait at a point-of-sale for a long warm-up and calibration cycle followed by a several minute long sublimation transfer process. Consequently, a successful retail sublimation system must be capable of on-demand production and heat generation while eschewing potential burn hazards or uncomfortably heating the ambient air of the rest of the store.

Additionally, a modular apparatus comprising various subsystems would be desirable, because it could be configured to meet particular needs or applications of a user in a cost-effective manner. Furthermore, such an apparatus could be designed to fit a variety of physical footprints, widening potential marketing possibilities.

One attempt at a dye sublimation printer system is described in International Publication No. WO 2005/105470 (the '470 publication) by Farrell, et al. published on Nov. 10, 2005. The '470 publication discloses a direct sublimation system wherein a desired image to be sublimated onto an object is printed directly on a textile fabric. The fabric is then laid onto a target object inside of an isolated chamber, and heat and pressure are introduced into the chamber to sublimate the image onto the object.

Although the systems and methods disclosed in the '470 publication may assist an operator in sublimating images onto a product, the disclosed system is limited. The system of the '470 publication does not easily lend itself to streamlined deployment in a retail environment, such as a countertop, because the system requires a large chamber with attachments to a fluid pressure system and a vacuum system.

Additionally, the direct-printing aspect of the '470 system onto a fabric membrane, such as lycra, would not be readily adaptable to multiple types of products. A membrane that fits one object well may not conform satisfactorily to fit the shape of another oddly-sized or shaped object, leading to lower transfer quality. The '470 system contains significant safety and efficiency limitations that would not make it ideal for a merchant, such as a retail outlet, seeking to add a small-footprint dye sublimation system to provide and market personalized products to consumers.

The disclosed system is directed to overcoming one or more of the problems set forth above and/or elsewhere in the prior art.

SUMMARY

The present invention is directed to an improved modular integrated sublimation printing apparatus. The advantages and purposes of the invention will be set forth in part in the description which follows, and in part will be apparent from the description, or may be learned by practice of the invention. The advantages and purposes of the invention will be realized and attained by the elements and combinations particularly pointed out in the appended claims.

In accordance with one aspect of the disclosed embodiments, an apparatus for sublimating an image on a product is disclosed. The apparatus comprises a dye sublimation transfer printer configured to print a digital image file representing an image on a sheet of transfer media. The apparatus further comprises a platen configured to receive and secure the product for sublimation, wherein the platen is configured to receive one or more different types of products into dedicated channels designed to fit the dimensions of each type of product. Further, the apparatus includes at least one light disposed on the plated to assist with alignment of one or more markers printed onto the transfer media. The apparatus includes one or more heating platens configured to engage the transfer media and sublimate the printed image onto one or more sides of the selected product. The apparatus also includes a housing substantially enclosing the dye sublimation transfer printer, platen, light, and one or more heating platens in a manner that prevents a user from contacting the enclosed components. The apparatus comprises a user interface device configured to confirm selection of the image to be printed.

In accordance with another aspect of the disclosed embodiments, a method is disclosed for sublimating one or more images onto a product using a sublimation apparatus comprising a user interface device, one or more heating platens, and a housing substantially enclosing the one or more heating platens. The method includes printing a digital image file representing the one or more images onto a sheet of transfer media. The method further includes receiving the product onto a platen of the apparatus, wherein the platen is configured to receive one or more different types of products into dedicated channels designed to fit the dimensions of each type of product. The method includes engaging the printed sheet of transfer media with the product, wherein the printed sheet of transfer media includes one or more markers printed onto the transfer media, and wherein the printed sheet of transfer media is aligned by aligning the one or more markers with one or more lights disposed on the platen. Additionally, the method comprises translating the platen from a position outside of the housing to a position within the housing aligned with the one or more heating platens. The method includes configuring a single thermal cycle for the one or more heating platens such that the one or more images will be sublimated substantially simultaneously onto one or more sides of the product in a single thermal cycle. Also, the method includes engaging the one or more heating platens and the transfer media, and sublimating the one or more images from the transfer media onto one or more sides of the product using the configured single thermal cycle of the one or more heating platens. The method further comprises translating the platen to a position outside of the housing to facilitate retrieval of the sublimated product.

In accordance with still another aspect of the disclosed embodiments, an apparatus for sublimating an image on a product is disclosed. The apparatus comprises a dye sublimation printer configured to print a digital image file representing an image onto a product. The apparatus further comprises a platen configured to receive and secure the product for sublimation, wherein the platen is configured to receive one or more different types of products into dedicated channels designed to fit the dimensions of each type of product. Further, the apparatus includes one or more heating platens configured to engage the product and sublimate the printed image onto one or more sides of the selected product. The apparatus also includes a housing substantially enclosing the dye sublimation printer, platen, and one or more heating platens in a manner that prevents a user from contacting the enclosed components. The apparatus further comprises a user interface device configured to confirm selection of the image to be printed.

In accordance with yet another aspect of the disclosed embodiments, a method is disclosed for sublimating one or more images onto a product using a sublimation apparatus comprising a user interface device, one or more heating platens, and a housing substantially enclosing the one or more heating platens. The method includes receiving the product onto a platen of the apparatus, wherein the platen is configured to receive one or more different types of products into dedicated channels designed to fit the dimensions of each type of product. The method includes translating the platen from a position outside of the housing to a position within the housing aligned with the one or more heating platens. The method includes configuring a single thermal cycle for the one or more heating platens such that the one or more images will be sublimated substantially simultaneously onto one or more sides of the product in a single thermal cycle. Also, the method includes engaging the one or more heating platens and the product, and sublimating the one or more images onto one or more sides of the product using the configured single thermal cycle of the one or more heating platens. The method further comprises translating the platen to a position outside of the housing to facilitate retrieval of the sublimated product.

In accordance with another aspect of the disclosed embodiments, an apparatus for sublimating an image on a product is disclosed. The apparatus comprises a dye sublimation transfer printer configured to print a digital image file representing an image on a sheet of transfer media. The apparatus further comprises a platen configured to receive and secure the product for sublimation, wherein the platen is configured to receive a cassette including the product and the printed sheet of transfer media. Further, the apparatus includes at least one mechanical implement disposed on the platen to assist with alignment of the cassette. The apparatus includes one or more heating platens configured to engage the transfer media associated with the cassette and sublimate the printed image onto one or more sides of the selected product. The apparatus also includes a housing substantially enclosing the dye sublimation transfer printer, platen, product, one or more mechanical implements, and one or more heating platens in a manner that prevents a user from contacting the enclosed components. The apparatus further comprises a user interface device configured to confirm selection of the image to be printed.

In accordance with yet another aspect of the disclosed embodiments, a method is disclosed for sublimating one or more images onto a product using a sublimation apparatus comprising a user interface device, one or more heating platens, and a housing substantially enclosing the one or more heating platens. The method includes printing a digital image file representing the one or more images onto a sheet of transfer media. The media further includes receiving a cassette including the product and the printed sheet of transfer media onto a platen of the apparatus, wherein the platen comprises one or more mechanical implements to assist with alignment of the cassette on the platen. The method includes translating the platen and aligned cassette from a position outside of the housing to a position within the housing aligned with the one or more heating platens. The method includes configuring a single thermal cycle for the one or more heating platens such that the one or more images will be sublimated substantially simultaneously onto one or more sides of the product in a single thermal cycle. Also, the method includes engaging the one or more heating platens and the transfer media associated with the cassette, and sublimating the one or more images from the transfer media onto one or more sides of the product using the configured single thermal cycle of the one or more heating platens. The method further comprises translating the platen and cassette to a position outside of the housing to facilitate retrieval of the sublimated product.

In accordance with still another aspect of the disclosed embodiments, an apparatus for sublimating an image on a product is disclosed. The apparatus comprises a dye sublimation printer configured to print a digital image file representing an image onto a product. The apparatus further comprises a platen configured to receive and secure the product for sublimation, wherein the platen is configured to receive a cassette including the product. Further, the apparatus includes at least one mechanical implement disposed on the platen to assist with alignment of the cassette. The apparatus includes one or more heating platens configured to engage the product associated with the cassette and sublimate the printed image onto one or more sides of the product. The apparatus also includes a housing substantially enclosing the dye sublimation printer, platen, product, one or more mechanical implements, and one or more heating platens in a manner that prevents a user from contacting the enclosed components. The apparatus further comprises a user interface device configured to confirm selection of the image to be printed.

In accordance with another aspect of the disclosed embodiments, a method is disclosed for sublimating one or more images onto a product using a sublimation apparatus comprising a user interface device, one or more heating platens, and a housing substantially enclosing the one or more heating platens. The method includes receiving a cassette including the product onto a platen of the apparatus, wherein the platen comprises one or more mechanical implements to assist with alignment of the cassette on the platen. The method includes translating the platen and aligned cassette from a position outside of the housing to a position within the housing aligned with the one or more heating platens. The method includes configuring a single thermal cycle for the one or more heating platens such that the one or more images will be sublimated substantially simultaneously onto one or more sides of the product in a single thermal cycle. Also, the method includes engaging the one or more heating platens and the product associated with the cassette, and sublimating the one or more images onto one or more sides of the product using the configured single thermal cycle of the one or more heating platens. The method further comprises translating the platen and cassette to a position outside of the housing to facilitate retrieval of the sublimated product.

Additional objects and advantages of the invention will be set forth in part in the description which follows, and in part will be apparent from the description, or may be learned by practice of the embodiments. The objects and advantages of the invention will be realized and attained by the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate various embodiments and aspects of the disclosed embodiments and, together with the description, serve to explain the principles of the disclosed embodiments. In the drawings.

DETAILED DESCRIPTION

Reference will now be made in detail to various embodiments, examples of which are illustrated in the accompanying drawings. Wherever possible, the same reference numbers will be used throughout the drawings to refer to the same or like parts.

Figure 1A:
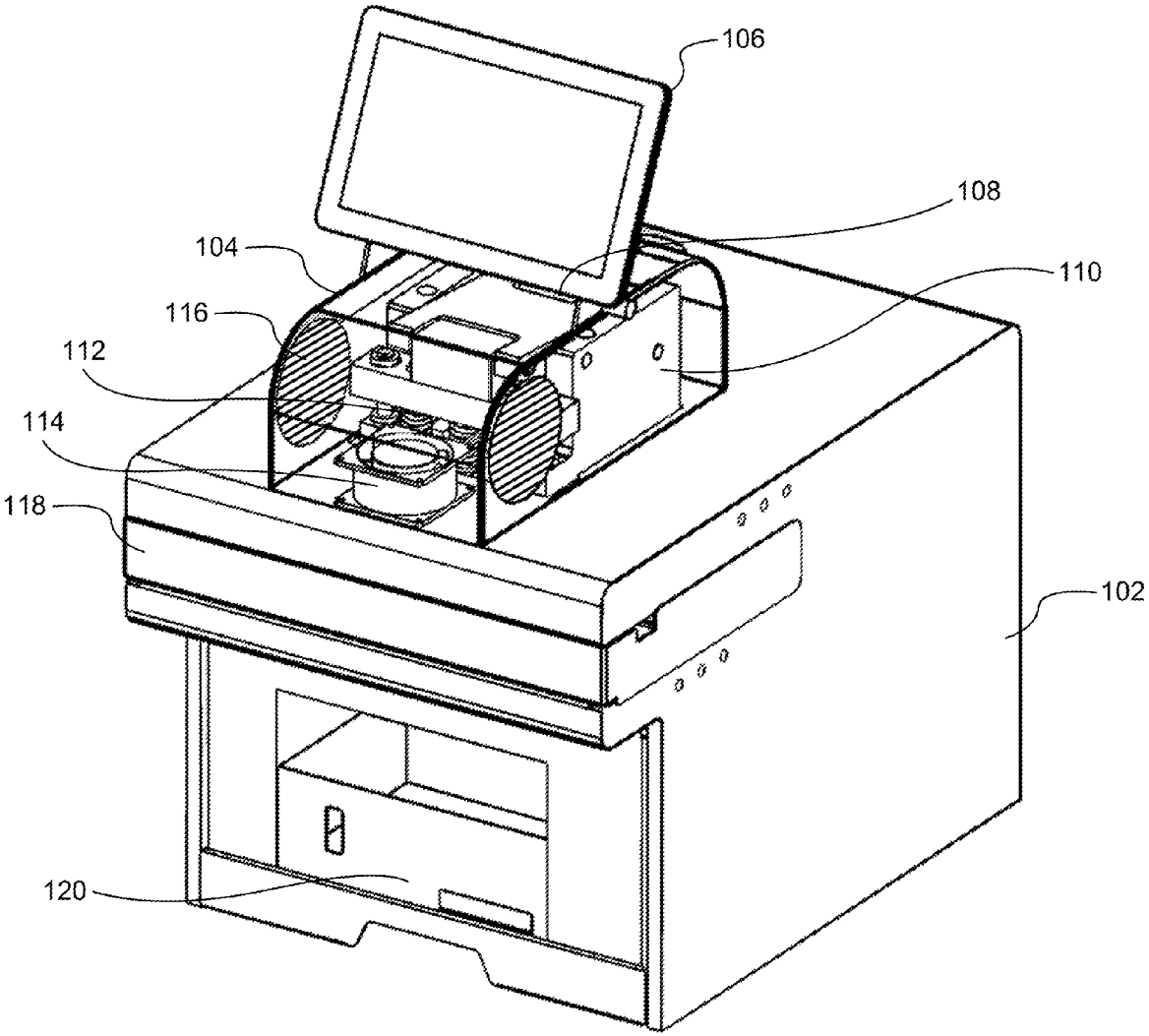
FIG. 1A is a pictorial front view of an exemplary dye sublimation transfer printing apparatus consistent with disclosed embodiments.
Figures 1B, 1C:
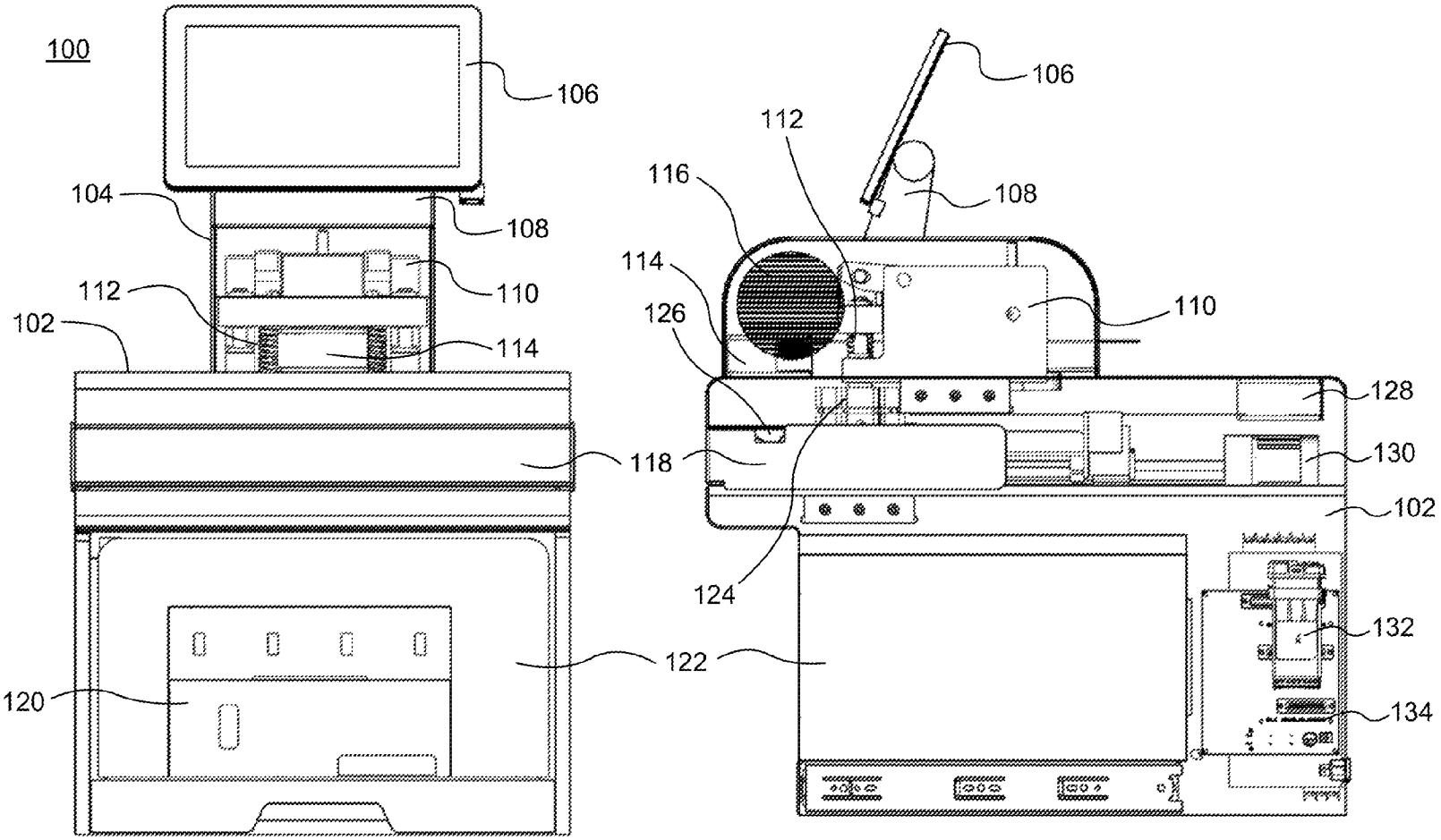
FIG. 1B is a front view of the dye sublimation transfer printing apparatus of FIG. 1A.
FIG. 1C is a side view of the dye sublimation transfer printing apparatus of FIG. 1A.

FIGS. 1A-1C illustrate an exemplary dye sublimation transfer printing apparatus 100. Apparatus 100 may contain various interchangeable modular fixtures configured to complete printing and sublimation tasks. As used herein, "modular" is not used in a manner requiring a completely separate modular arrangement. Rather, "module" is used more generally to refer to the components necessary to provide the required functionality. In effect, the noted modules are subsystems within the integrated apparatus. Depending upon the applications and requirements of a given consumer, the integrated apparatus can be customized to include only the desired subsystems. As such, FIGS. 1A-1C illustrate but one example of an apparatus within the scope of the invention. Apparatus 100 may be configured in a variety of ways depending on the needs and applications of the user.

Apparatus 100 may be configured as a clerk-operated kiosk with an offboard inventory of products to be sublimated. In this configuration, as will be discussed in further detail below, a subset of the modules discussed above may be manual variations operable by an operator such as a clerk or employee of a retail establishment. A clerk-operated kiosk may be situated in a retail establishment in a location accessible to employees of the establishment, such as behind a counter or in a restricted area. In the clerk-operated kiosk configuration, apparatus 100 may or may not have all components enclosed.

In alternative embodiments, apparatus 100 may be configured as a consumer-operated kiosk with an offboard inventory of products to be sublimated. In this configuration, a subset of the automated modules discussed above may be substituted with manual variations operable by an untrained operator such as a consumer of a retail establishment. A consumer-operated kiosk with an offboard inventory of products to be sublimated may be situated in a retail establishment in a location potentially accessible both to consumers of the establishment and to employees of the establishment. In the consumer-operated kiosk configuration, apparatus 100 may or may not have all components enclosed. The non-enclosed components may not be fully accessible to the consumer. In some embodiments, apparatus 100 may be configured as a hybrid kiosk with offboard inventory, with some modules configured to be operable by a clerk, and some configured to be operable by a consumer.

The modular subsystem features of the apparatus promote deployment of the apparatus in a variety of ways. The apparatus may be suitable for customizable footprints to meet the needs of the hosting entity. For example, if the apparatus must fit in the corner of a room, the modular design may permit the device to wrap around the corner. A "countertop" configuration might be a good fit for a jewelry counter at a department store. The subsystem configuration increases the flexibility and versatility of the apparatus and increases the market possibilities for the invention. In another example embodiment, a single dye sublimation transfer printer may be associated with multiple sublimation apparatuses, such that multiple sublimation tasks may be ongoing simultaneously.

Products for sublimation may be comprised of various materials. In some embodiments, the products may be comprised of plastic. In other embodiments, the products may be comprised of metal, such as aluminum, brass, or steel. In alternative embodiments, the products may be comprised of a ceramic material, a fabric or textile material, wood, fiberglass, or glass. In some embodiments, the product, regardless of its constituent material, may be additionally coated with a material to enhance integration and permanence of the sublimation dye, such as a polyester material. The added coating may be introduced to the surface of the product in various ways, such as spraying, dipping, painting, etc.

Possible candidate products and accessories for use in apparatus 100 may include, but are not limited to, luggage tags, pet tags, bookmarks, identification tags, dog tags, gift tags, ornaments, picture frames, picture frame inserts, cases for a mobile device, inserts for cases for a mobile device, various types of jewelry, such as pendants, bracelets, watch bands, earrings, necklaces, etc., fabrics, such as clothing, banners, draperies, etc., and any item that could integrate sublimation dye and bear a sublimated image. In some embodiments, products for sublimation in apparatus 100 are flat plates with opposing surfaces. In some embodiments, the products for sublimation may include keys, key heads, or key blades. In other embodiments, products could be flat, three-dimensional shapes, such as cubes. In still other embodiments, curved surfaces are possible. In these embodiments, products such as coffee mugs, decorative glass products such as vases or barware, sports balls, and medical identification bracelets could be candidates for receiving sublimated images. Candidate products for sublimation may be provided by the user, or they may be disposed within or proximal to the printing apparatus. In some embodiments, described in further detail below, the apparatus may be configured as a vending apparatus and the products may be situated inside of the apparatus. In some configurations, the vending apparatus may be capable of receiving a product inserted into the machine by a user. The apparatus may be further configured to receive, sublimate, and/or dispense accessory items that match or accompany candidate products for sublimation. The accessories, in a similar manner to the products, may be contained within the apparatus, proximal to the apparatus, or may be inserted into the apparatus by a user. Examples may include, but not be limited to, picture frames, luggage tag holders, bracelets, jewelry, key chains, necklaces, key rings, etc. In some embodiments, the inserted accessory may be a pre-packaged accessory designed to accompany the customized sublimated product.

Components of apparatus 100 will now be described in detail. These components may be substantially contained within a housing, such as housing 102 shown in FIGS. 1A-1C. Housing 102 may be configured to enclose some or all of the components of apparatus 100 in a manner that prevents an operator from contacting the enclosed components. Housing 102 may be comprised of metal, plastic, glass, or a combination thereof. Housing 102 may serve several important functions; it protects the operator (or others) from burn, pressure, pinch, or puncture injuries that could occur as a result of contact with the apparatus components. Further, housing 102 protects the apparatus itself, shielding the components from wear and tear and keeping them clear of dust, insects/animals, etc. Components involving heat or cold may be disposed within housing 102 such that they do not touch any of the housing walls, so as to maintain the external surface of housing 102 at a temperature safe for touch.

Housing 102 may be configured to include one or more shells 104. The materials comprising shell 104 may include, as non-limiting examples, acrylic, glass, fiberglass, plastic, or a hybrid material. Shell 104 may be oriented in a manner that makes the components of a dye sublimation printer apparatus, such as apparatus 100, visible to a clerk, other operator, or consumer while safely shielding the user from heat, pinch points, stored energy sources, and other such potential hazards associated with the operation of heavy machinery. Shell 104 may provide entertainment and education to the user while the sublimation task is underway, and may also allow an operator to take note of components of the apparatus requiring maintenance or repair. Shell 104 may be disposed atop housing 102, as shown in FIGS. 1A-1C. Alternatively, shell 104 may be disposed within or on a side of housing 102.

User interface device 106 may be configured to assist a consumer in selecting and confirming one or more images to print on the transfer media, selecting one or more products on which to sublimate the printed images, and coordinating payment for the product. Device 106 may include input and output components to enable information associated with the sublimation task to be provided to a user, and also for the user to input required information. In some embodiments, the input components may include a physical or virtual keyboard. For example, a consumer may first be prompted by device 106 to determine one or more images to be printed by an associated printer onto sheets of transfer media. In some embodiments, device 106 may be configured to contain a library of digital image files within an associated memory device, or in a memory device or database accessible over a network connection. In other embodiments, user interface device 106 may be configured to receive a digital image file in various additional ways, including but not limited to receiving insertion of flash memory or a USB drive, connecting via a USB or Firewire® cable, receiving image files by email, receiving image files uploaded via a mobile application, retrieving user-submitted image files from an online library or website, etc. In some embodiments, user interface device 106 may be configured to transmit or receive information from a mobile application associated with one or more of a manufacturer of the vending apparatus, a retailer hosting the vending apparatus, or a third party.

In these embodiments, apparatus 100 and the mobile application may be configured to exchange information relating to the consumer and/or to a sublimation task associated with the user. The information may comprise one or more of information associated with a product the consumer wishes to sublimate, information associated with an image or text to be sublimated on the product, information associated with payment for the sublimated product, or information comprising a location of the nearest vending apparatus. In some embodiments, apparatus 100 may be configured to receive a fully pre-paid, pre-configured order for a sublimation task from the mobile application. In these embodiments, apparatus 100 may receive the order directly from the mobile application via user interface device 106 (for example, if a particular apparatus 100 is determined to be the closest geographically to the consumer). In other embodiments, user interface device 106 may be configured to access a remote server to retrieve information relating to the order from the mobile application. In these embodiments, apparatus 100 may be configured to receive a code configured to facilitate access by user interface device 106 to information associated with a saved transaction ordered from the mobile application.

In some embodiments, user interface device 106 may be capable of outputting audible notifications or alerts to a consumer or operator of apparatus 100. For example, user interface device 106 may be configured to tell the user to "LOOK AT THE SCREEN" when information is required from the user or important information is displayed for the user. In yet another embodiment, device 106 may be configured to audibly output "YOUR PRODUCT IS READY" when the sublimation process is complete and the product is cooled to a safe handling temperature. In some embodiments, the audio output capabilities of apparatus 100 may extend to the input components. User interface device 106 may include one or more display screens, which may serve as both an input and output device. User interface device 106 may be configured such that key presses on a virtual keyboard or touchscreen buttons associated with the one or more display screens elicit confirmatory clicking noises. Additionally, the input components of device 106 may be configured to provide tactile or visual feedback to the user to indicate that an input member, such as a key of a keyboard, has been successfully pressed.

In some embodiments, user interface device 106 may permit the consumer to select from a plurality of possible stock images to incorporate personal information in textual form. In these embodiments, device 106 may be configured to, at the selection of the consumer, synthesize the personal information into a selected stock image from the device memory, and provide the single synthesized image to the included printer for printing onto transfer media. This process is described in further detail below in association with FIGS. 8 and 13-18. Device 106 may be configured to store the received personal information as well as any personalized, synthesized, or stock images created or selected by the consumer. Further, device 106 may be configured to prompt the consumer for additional products that they may desire to have sublimated with the same image.

In some embodiments, user interface device 106 may be configured to transmit the stored consumer image to a remote network server, and may communicate an indication to the consumer regarding information about additional sublimated or customized products that might be available for the consumer that can be printed and shipped from a remote location. The indication may be communicated to the consumer through various known means of communication, such as by telephone, email, social media, or on an internet webpage associated with one or more of the consumer, the retail outlet hosting apparatus 100, or the maker of apparatus 100. In some embodiments, user interface device 106 may provide further options to the user, including customizing and purchasing accessories for the sublimated product, or configuring a delivery vehicle for the product. User interface device 106 may also be configured to prompt the user to select a companion accessory for the sublimated product. In some embodiments, the accessory also may be capable of sublimation by the apparatus. Device 106 may be configured to coordinate and collect payment for the accessory. In some embodiments, apparatus 100 may be configured to utilize the used transfer media as a delivery vehicle for the sublimated product. In such embodiments, the transfer media may be preprinted on one or more sides with text or images associated with the retail outlet hosting apparatus 100, or the manufacturer of apparatus 100.

Although apparatus 100 is illustrated in FIGS. 1A-1C as a dye sublimation transfer system that prints images onto an intermediate sheet of transfer media, in alternative embodiments apparatus 100 may be configured as a direct printing system. In these embodiments, no sheet of transfer media is used, and apparatus 100 and an associated printer may be configured to sublimate images directly onto products. As described above, these products, regardless of their constituent material, may be additionally coated with a material to enhance integration and permanence of the sublimation dye, such as a polyester material. The added coating may be introduced to the surface of the product in various ways, such as spraying, dipping, painting, etc. The products may be configured in the factory to bear these coatings, or the coating may be added at a retail establishment in order to sublimate the product within a direct sublimation system. In these embodiments, a printer associated with apparatus 100 may be configured to print the images directly onto products, via inkjet, laser jet, or other technologies known in the printing arts. Heat, pressure, and duration of the direct sublimation process may be configured for each product by user interface device 106 in the same manner as described for a transfer sublimation system.

In some embodiments, user interface device 106 may be further configured to coordinate and collect payment for a sublimation task. A memory associated with user interface device 106 may contain information relating to pricing for various types of products. The pricing may vary by product, and may vary based on other predetermined criteria, such as the quantity of objects desired, image processing tasks completed, images acquired via an associated camera, etc. User interface device 106 may display the pricing information on an output screen to the user via a graphical user interface. In some embodiments, device 106 may include, or be connected to, payment acceptance components that can accept cash, credit cards, or other payment methods from the consumer, such as a coupon, or a payment application on a mobile device.

In other embodiments, user interface device 106 may include an associated printer that can provide the consumer with a payment ticket containing information regarding the payment transaction. The consumer may then carry the payment ticket to a cashier for payment. The associated printer may be the same printer used for printing images on transfer media, or it may be a different, dedicated printer. In some embodiments, the payment ticket may also serve as a receipt, and may also contain other information, such as an Internet URL for a website associated with either the retail outlet hosting apparatus 100, or the manufacturer of apparatus 100 for purposes of marketing additional possible products. It should be understood that a device similar to user interface device 106, with any of the above configurations, may be provided as part of any apparatus consistent with disclosed embodiments.

User interface device 106 may be coupled to housing 102 via screen mount 108. Screen mount 108 helps keep user interface device 106 away from any heat or moisture associated with the operations of apparatus 100. Additionally, screen mount 108 may be configured to be rotatable in the X, Y, or Z planes. In the example illustrated in FIGS. 1A-1C, screen mount 108 is rotatable in the Y axis, enabling the attached user interface device 106 to be "flipped" in orientation from top to bottom around a fulcrum associated with screen mount 108. The information displayed on user interface device 106 may be configured to move along with device 106 as it translates via screen mount 108. For example, the orientation of the information may rotate 90 or 180 degrees as needed so that it can be viewed and read normally in any position of user interface device 106 and screen mount 108. This process is described in further detail in association with FIGS. 5A-5B below.

As will be discussed in further detail in association with FIGS. 2A-2C, components of the sublimation machinery may be disposed within shell 104, such as press assembly 110. Press assembly 110, which will be discussed in further detail below in association with FIGS. 3 and 4, may comprise various mechanical components assembled for the purpose of providing heat and pressure for a sublimation process. In some embodiments, press assembly 110 may be disposed atop housing 102. In other embodiments, press assembly 110 may be disposed within housing 102. Finally, in still other embodiments, press assembly 110 may be disposed such that a portion of the assembly is outside of housing 102 and a portion is inside of housing 102.

Press assembly 110 may be configured as a spring-loaded system. In these embodiments, such as the embodiment illustrated in FIGS. 1A-1C, springs 112 may be disposed as part of press assembly 110. As will be discussed in further detail below, components of press assembly 110 such as springs 112 may be configured to monitor and manage the pressure and force applied to a product during a sublimation task. In certain embodiments, springs 112 are springs that have a high spring constant. The purpose of springs 112 is to provide compliance and sensitivity to the pressing operation, to enable apparatus 100 to sublimate many products of different sizes, shapes, and composition.

In some embodiments, apparatus 100 may include a cooling system 114. In these embodiments, the cooling system may be configured to cool the sublimated product to at least about an ambient temperature. The cooling process provides safety for handlers of the sublimated object, and also helps ensure the quality and permanence of the sublimation transfer by preventing smearing, blistering, etc. In the embodiment illustrated in FIGS. 1A-1C, cooling system 114 is a fan that cools the hot sublimated product. As will be described in further detail below in association with FIGS. 2A-2C, lower platen 118 may be automatically translated by components of apparatus 100 from a sublimation position in alignment with press assembly 110 and associated heating platens to a position in alignment with cooling system 114. After a predetermined cooling period (which may be unique for every product and/or the complexity of every sublimated image), apparatus 100 may eject lower platen 118 and the cooled product may be presented to the consumer by the apparatus operator.

In some embodiments housing 102 may be equipped with a ventilation system. In the example of FIGS. 1A-1C, the ventilation system is represented by shell vents 116. The ventilation system may result in ambient air flowing into the machine, either by natural convection or by forced convection, such as through a series of fans. In embodiments where housing 102 is configured to contain a ventilation system, the ventilation system may be further configured to interface with a larger ventilation system for the retail establishment or other structure hosting the apparatus. A ventilation system may permit heating platens associated with press assembly 110 to be kept at a steady state intermediate temperature or even at full operational temperature, without creating burn risks to users or excessively raising the ambient temperature of the surrounding air. In some embodiments, the ventilation system may be configured to control a temperature within housing 102 such that the mechanical and electrical components of apparatus 100 are protected from damage and the exterior surface of housing 102 and transparent shell 104 remain touch-safe (e.g., at a temperature that will not harm an individual when that individual's skin contacts the surface). Allowing the enclosed components, including the heating platens, to remain at an intermediate but safe temperature reduces system warm-up time and consumer wait time.

Lower platen 118 is a substantially flat platen configured to receive the product to be sublimated and the transfer media and align and register them to prepare for the sublimation process. In certain embodiments, lower platen 118 may be configured in the form of a "drawer" that translates inside and outside of housing 102. This configuration will be described in further detail in association with FIGS. 2A-2C. In certain embodiments, lower platen 118 may be a bare platen comprised of a metal, such as steel or aluminum, in order to provide structural support along with optimal heat conductivity properties. In alternative embodiments, lower platen 118 may be comprised of plastic, or a composite product. In alternative embodiments, lower platen 118 may be configured to provide additional heat to the sublimation process. Lower platen 118 may include components that assist in positioning and securing the transfer media to ensure faithful transfer of the printed image to a desired product. In some embodiments, lower platen 118 may include features, such as contact or non-contact sensors, to assist with the registration and alignment of the transfer media and/or the products that will receive the sublimated image. Further detail of these features is described below and illustrated in FIGS. 6 and 7.

Apparatus 100 may interface with a printer for printing images onto transfer media. The printer may be disposed within housing 102, and accessed via printer access opening 120. Printer 122 is illustrated in FIGS. 1B and 1C, with printer access opening 120 visible in FIGS. 1A and 1B. In some embodiments, printer 122 may be electronically configured to receive a file representing a digital image from an operator or a consumer. The digital image file may represent images such as pictures, text, stylized text, or a combination of these elements. In some embodiments, printer 122 may receive the digital image file directly, and may include digital media input interface components. In other embodiments, the printer may be linked via a physical or a network connection to a distinct interface device or module (such as user interface device 106) which is configured to permit a user to determine a digital image file for printing.

In some embodiments, printer 122 may be configured to receive a file representing a digital image selected at the point of sale by a user from a library or database containing a plurality of preloaded stock image files. As discussed above, such a library or database may be stored in a memory associated with user interface device 106, or may be accessible via a network connection. In yet other embodiments, apparatus 100 may be capable of receiving input in the form of text from a user, and may convert or incorporate the text into a printable digital image file for sublimation. Printer 122 may be configured to utilize standard sublimation dyes known in the art to print the received digital image file onto suitable transfer media. The transfer media may comprise any material capable of receiving a printed dye image, including but not limited to coated or uncoated paper, card stock, film, resin, wax, ribbon, tape, etc.

In the illustrations shown in FIGS. 1A-1C, printer 122 is configured to print images onto individual sheets of transfer media. In some embodiments, printer 122 may include or be connected to a bulk storage unit containing a plurality of sheets of transfer media. In other embodiments, individual sheets of the transfer media may be fed into printer 122 one sheet at a time by an operator. Alternatively, printer 122 may be configured to automatically feed the sheets of transfer media into proximity with the print head and sublimation dyes for printing. In still other embodiments, printer 122 may be configured as a manual, hand-fed printer in which an operator may introduce each sheet of transfer media into the printer. Some embodiments of apparatus 100 may be configured for both manual and automatic sheet feeding.

Printer 122 may be configured to print a dye image on one side of each sheet of the transfer media, or alternatively may be capable of printing dye images on both sides of each sheet. Printer 122 may be configured to print the images in a single pass, or may require two passes, such as for complex images, multiple colors, or multiple layers of images. For example, a printed dye image may include multiple distinct images superimposed into a single image. The printer may print the superimposed image in a single pass, or may print each constituent image in its own pass through the machine.

In kiosk embodiments with offboard inventory, apparatus 100 may be configured to simply allow an operator to place and transport the printed transfer media by hand to other parts of the system. In these embodiments, printer 122 may be disposed in a manner such that it is separate from the rest of the components of apparatus 100 and not enclosed within housing 102. For example, apparatus 100 and printer 122 may not be physically co-located. In these embodiments, an operator may feed the sheet or sheets of transfer media into printer 122 for printing, and then manually place the transfer media, now containing the printed images, into the other components of apparatus 100.

The illustration of apparatus 100 in FIG. 1C reveals additional features of the apparatus. For example, apparatus 100 may sublimate the printed images on the transfer media to selected products using heating platen 124. Apparatus 100 may contain one or more heating platens. In the embodiment illustrated in FIGS. 1A-1C, apparatus 100 contains a single heating platen 124. However, in alternative embodiments, more than one heating platen may be employed in apparatus 100, and lower platen 118 may be configured to include a second heating platen.

Heating platen 124 may be comprised of any heat-conductive material, such as metal or ceramic. In some embodiments, heating platen 124 is comprised of cast iron, aluminum, or zinc. Heating platen 124 may be surrounded by an additional heat shield (not shown), which may be comprised of a material that insulates the system and reduces heat transfer to the exterior surfaces and surrounding elements of apparatus 100. If present, the heat shield may be comprised of metal, plastic, ceramic, rubber, or any other suitable material.

Heating platen 124 may additionally be coated with a compliant material. Such a coating may comprise a foam, rubber, or plastic possessing the ability to maintain structural integrity under high temperatures and pressures. The compliant nature of the platen coating assists in the application of an even heat and pressure across all surfaces to be sublimated. Maintaining consistency of heat and pressure results in higher quality sublimated products, and reduces the risk of damage to either the product or the platen. In some embodiments, lower platen 118 may be similarly coated with such a compliant material. In some alternative embodiments, heating platen 124 itself may have inherent flexibility, and may be capable of deformation across a product during sublimation to ensure even application of heat and pressure.

As will be described in further detail below, apparatus 100 may be configured to bring heating platen 124 and the transfer media as situated on lower platen 118 into contact in order to sublimate printed images onto a product. It is to be understood that various configurations of heating platen 124, lower platen 118, and other components of apparatus 100 are possible, and that all such configurations are contemplated by the claims. In some embodiments, heating platen 124 may be moved into contact with lower platen 118 and the transfer media (which remain stationary) by apparatus 100 via press assembly 110. In other embodiments, lower platen 118 may be moved into contact with heating platen 124 (which remains stationary). In still other embodiments, both heating platen 124 and lower platen 118 may be moved.

Product platen 126 may be configured to mechanically interface with lower platen 118. The purpose of product platen 126 is to enable apparatus 100 to sublimate a wide variety of different products with high-quality images. Product platen 126 will be illustrated and described in detail in association with FIG. 6, but in brief, product platen 126 may be configured in a manner that allows multiple types of products to be aligned and secured for sublimation. Rather than a "one size fits all" approach, the customizable configuration of product platen 126 provides additional versatility and flexibility to apparatus 100. As a non-limiting example, in an embodiment of apparatus 100 deployed in a pet store, product platen 126 may be configured to accept one or more different types of pet-related products. For example, product platen 126 may be deployed in a cruciform shape. In these embodiments, on the longer axis, product platen 126 could accept long, narrow products for sublimation such as collars and leashes. On the shorter axis, product platen 126 could accept more compact products, such as pet tags, luggage tags, plaques for pet bowls, etc. Product platen 126 may be configured in whatever manner is necessary to accept particular products, and may be configured with various lengths, widths, and depths. In some embodiments, multiple product platens 126 may be available for a given apparatus 100 and lower platen 118, and an operator may be able to switch out the various product platens 126 based on the details of a particular sublimation task. Product platen 126 may be made out of aluminum, for light weight and structural integrity, but in other embodiments may be made from other metals, plastics, or composites.

Once heating platen 124 and lower platen 118 are brought into contact by press assembly 110, heating platen 124 may be operated by apparatus 100 in a single thermal cycle to sublimate the printed images from the transfer media onto the product. The single thermal cycle of heating platen 124 may be configured with a temperature, pressure, and duration sufficient to successfully transfer the image(s) to the selected product. These operations are controlled and coordinated by thermal management unit 128, motor 130, heater controller 132, and motion controller 134. The duration of the thermal cycle, measured as the dwell time of the platen on the transfer media, may vary based on the product to be sublimated, the transfer media, and the heating temperature of heating platen 124. In some embodiments, heating platen 4 is maintained by heater controller 132 and thermal management unit 128 at a temperature of about 400 degrees Fahrenheit for the entirety of the time that it is in contact with the transfer media. The pressure of the thermal cycle may be about 30 to 40 psi, but may vary based on, for example, the composition of the product or the complexity and color scheme of the image to be sublimated.

The temperature, duration, and pressure of a heating platen 124 single thermal cycle may be determined based on a variety of predetermined criteria. In some embodiments, the predetermined criteria may include properties of the product being sublimated, including but not limited to dimensions of the product, the material comprising the product, the product's shape or curvature, etc. In these embodiments, the product may be configured in a manner that presents this information to apparatus 100 and to heater controller 132 and motion controller 134. For example, individual products may be marked with a barcode, a QR code, or other such indicia that may be scannable or otherwise readable by apparatus 100. This indicia may contain information such as that described above that is unique to each product and provides guidance as to the parameters needed to configure the thermal cycle for apparatus 100. Alternatively, user interface device 106 may be periodically programmed to contain this information for all available products associated with a particular apparatus 100, and user interface device 106 may be configured to transmit this information to heater controller 132 and motion controller 134.

In some embodiments, the predetermined criteria informing the configuration of the thermal cycle may include characteristics of the printed images, including but not limited to pixel intensity or density of the printed image, colors utilized in the image, size of the image, etc. In some embodiments, heating platen 124 may be configured to provide differential heating based on the predetermined criteria; for example, one or more regions on heating platen 124 may be heated to a different temperature than one or more other regions on the platen. The differential heating may correspond with one or more regions of product platen 126 that support the product. In these embodiments, apparatus 100 may provide an energy savings by heating only the regions of heating platen 124 that are needed for a particular product. In other embodiments, the differential heating may comprise one or more regions on heating platen 124 that transmit heat for a different duration of time than one or more other regions on the platen. Different pressures may also be utilized. Pressure as used herein may refer to a programmed force configured by the control and exerted as a pressing force by heating platen 124 and press assembly 110, or it may relate to a position in three dimensional space achieved by heating platen 124 during the thermal cycle.

To facilitate optimal sublimation in a single thermal cycle, the duration of the cycle may be altered depending on the thickness or material composition of the product. The programmed duration must account for thermal resistance within the material comprising the product, and must ensure that all surfaces of the product are exposed to a proper sublimation temperature of, for example, 350 degrees Fahrenheit without overheating, warping, or otherwise damaging the platen, the product, or the transfer media. As an example, a thin, polyester pet collar may have different thermal cycle parameters than a metal dog tag or a thick porcelain dog bowl.

The single thermal cycle of heating platen 124 may be further governed by external factors, such as conditions within the establishment hosting apparatus 100. It is desirable that apparatus 100 be capable of operating within a conventional electrical power configuration, utilizing either a standard 120 volt plug or a dedicated 240 volt plug, such as that used in larger household appliances. Apparatus 100 must be capable of heating relatively quickly without exceeding or draining the power capacity of its host establishment. Therefore, in some embodiments where available power is limited, apparatus 100 and heating platen 124 may be configured in the control software of heater controller 132 and thermal management unit 128 with alternate automated warm-up and cool-down cycles to permit successful sublimation within an existing electrical configuration. In these embodiments, apparatus 100 may be flexibly reconfigured via the control software to integrate into various deployment environments without the need to replace, alter, or custom design hardware components.

As described above, in some embodiments, lower platen 118 may be configured to translate in and out of housing 102. In these embodiments, lower platen 118 may be disposed on a linear motion stage (not shown), and its motion may be controlled by motor 130 and motion controller 134. Whether apparatus 100 is deployed as a clerk-operated kiosk, or as an automated system, safety and efficiency are essential in a sublimation system. The placement of lower platen 118 on a linear motion stage allows increased accessibility to the platen by an operator or by components of an automated system. More detail about this system is described below in association with FIGS. 2A-2C.

Depending on the configuration of apparatus 100, the linear distance traveled by one or both of lower platen 118 and/or heating platen 124 may be monitored and programmed as part of the single thermal cycle in lieu of or in addition to the pressure provided by press assembly 110. This monitoring may be performed, for example, by motion controller 134. Additionally, linear distance may be measured based on the compression force experienced by springs 112 of press assembly 110, which will have a known spring constant permitting accurate force and distance calculations. Alternatively, a linear potentiometer, linear variable differential transformer (LVDT), or other linear measuring sensor associated with motion controller 134 may be utilized to monitor and control the press distance.

Controlling linear distances may be important for avoiding breakage of a sublimated product and/or damage to the components of apparatus 100. Such a measurement could be particularly useful in the sublimation of fragile, three-dimensional objects such as ornaments or jewelry. Linear distance may be measured in alternative embodiments as the distance between heating platen 124 and lower platen 118. This linear distance may be preset for particular products based on their known dimensions, and may be included in the product-specific information described above. This information may also be integrated into readable indicia on the products themselves, or again pre-programmed into a memory or database associated with user interface device 106. In these embodiments, one or both of lower platen 118 or heating platen 124 may be pre-configured (e.g. through software associated with motion controller 134) to have a "hard stop" that achieves a desired linear distance while ensuring safety of users and preventing damage to system components. In some embodiments, motion controller 134 and heater controller 132 may operate in concert to automatically configure these parameters for the heating platen 124 and lower platen 118 for a particular sublimation task.

Figure 2A:
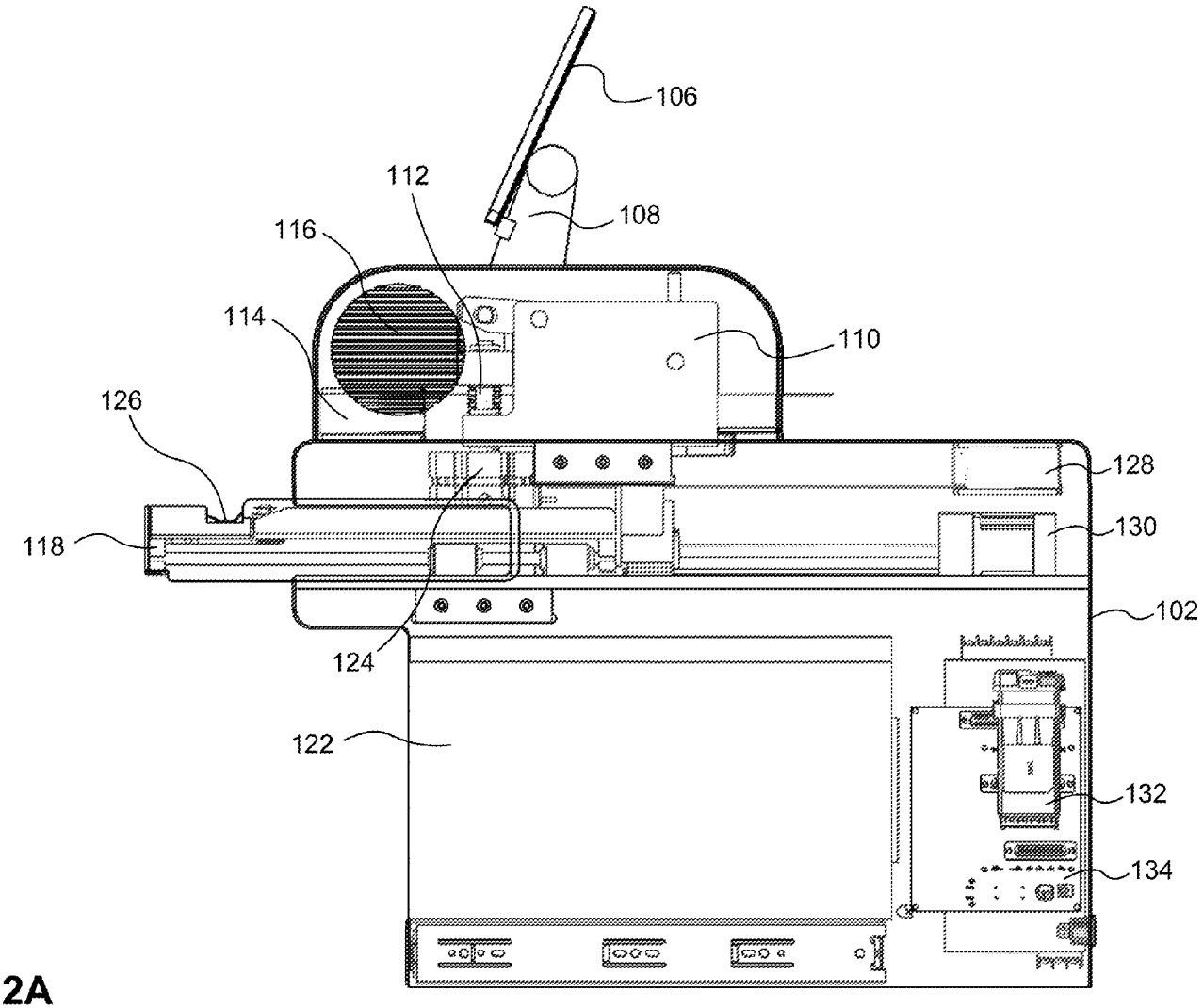
FIG. 2A illustrates the dye sublimation transfer printing apparatus of FIGS. 1A-1C with part of the exterior housing rendered transparently to show detail, with the lower platen of the apparatus in the product loading position, consistent with disclosed embodiments.
Figure 2B:
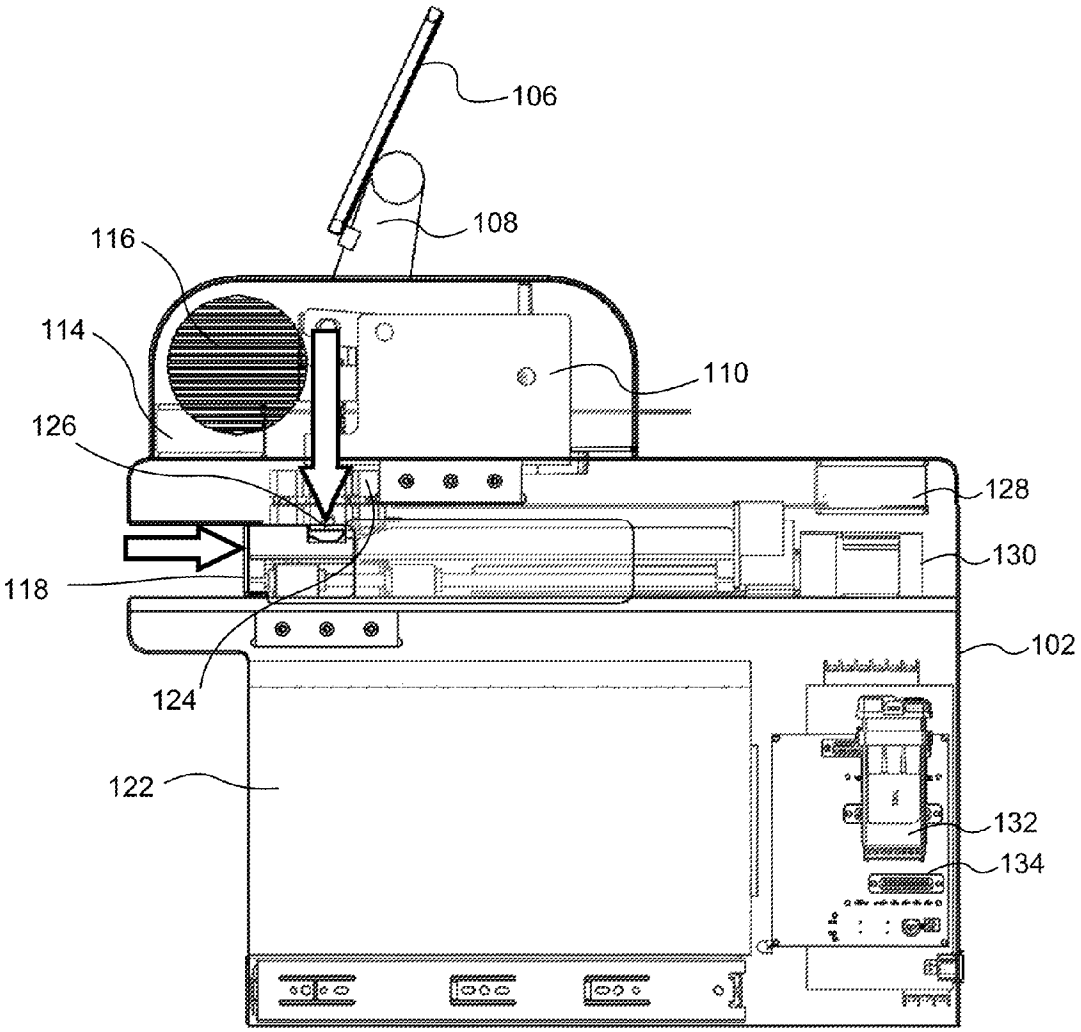
FIG. 2B illustrates the dye sublimation transfer printing apparatus of FIGS. 1A-1C with part of the exterior housing rendered transparently to show detail, with the lower platen in the product sublimation position, consistent with disclosed embodiments.
Figure 2C:
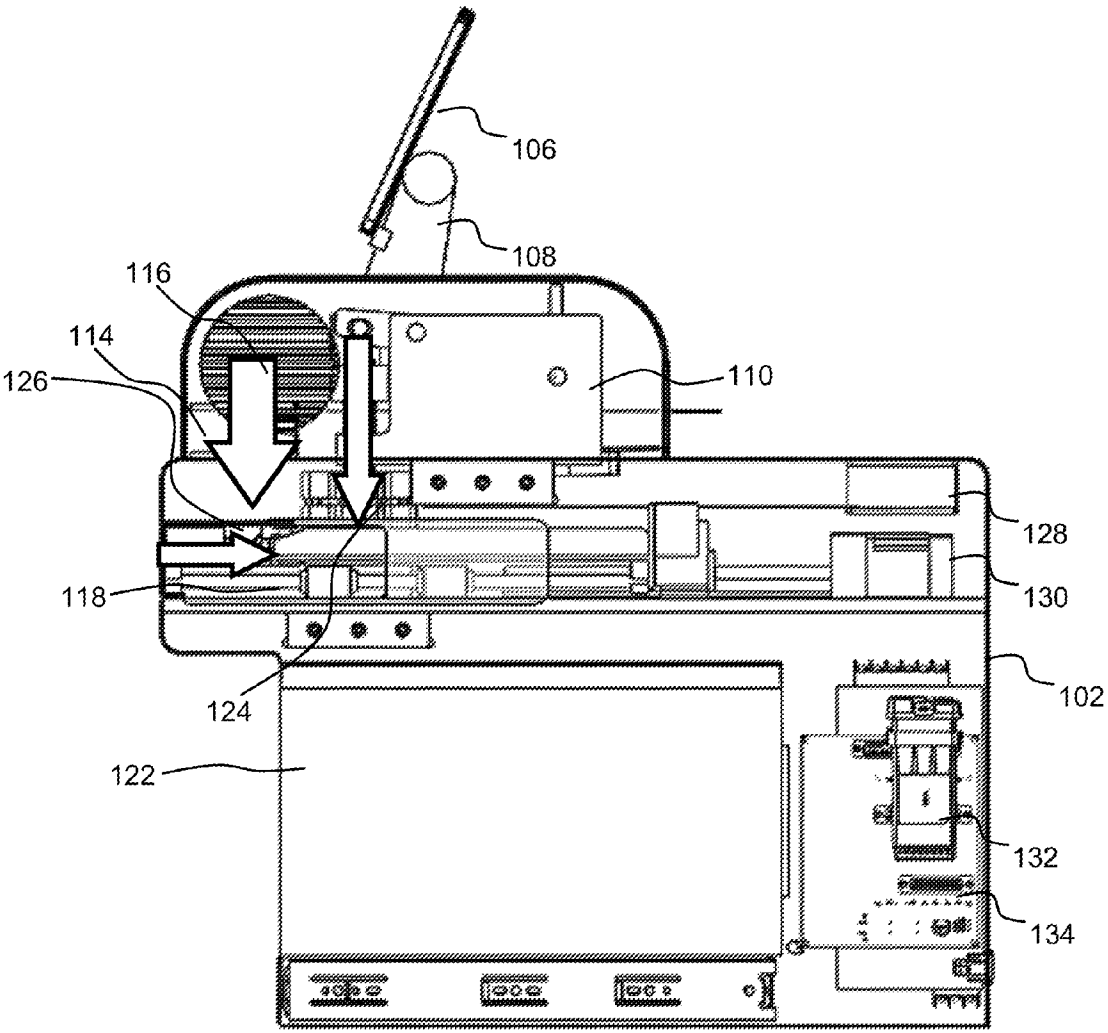
FIG. 2C illustrates the dye sublimation transfer printing apparatus of FIGS. 1A-1C with part of the exterior housing rendered transparently to show detail, with the lower platen in the product cooling position, consistent with disclosed embodiments.

FIGS. 2A-2C illustrate different stages of a typical sublimation task for apparatus 100 as controlled by heater controller 132 and motion controller 134. In these embodiments, lower platen 118 may be conveyed to various pre-configured "stop" positions within and outside of housing 102 by motor 130 and motion controller 134. These positions may be a pre-defined distance away from other elements of apparatus 100 associated with heat and pressure. The stop positions may be registered in a coordinate system or other such localization system, and may enable motion controller 134 to return lower platen 118 to a proper initial position before and/or after each sublimation cycle.

In certain clerk-operated embodiments of apparatus 100, the operator can place and align the product and the transfer media without worry of danger from other system elements. This stage of the process is illustrated in FIG. 2A. In this configuration, motor 130 and motion controller 134 have ejected lower platen 118 from inside of housing 102 to a position outside of housing 102 where lower platen 118 and product platen 126 are readily accessible. Apparatus 100 may reach the configuration at two different points during a typical sublimation task: at the beginning of the task, when the product and printed transfer media are loaded onto product platen 126, and at the end of the task, when the transfer media is removed by the operator and the cooled, sublimated product is removed and provided to the consumer. In some embodiments, apparatus 100 may be configured as shown in FIG. 2A at all times. In other embodiments, apparatus 100 may be configured in a manner where lower platen 118 is secured within housing 102 when not in use in order to prevent unauthorized access to the system. Motor 130 and motion controller 134 may be configured to "pop out" lower platen 118 in response to various stimuli. In some embodiments, motor 130 and motion controller 134 may cause lower platen 118 to emerge from housing 102 in response to an operator providing proper security credentials to apparatus 100 via user interface device 106. In other embodiments, motor 130 and motion controller 134 may cause lower platen 118 to emerge from housing 102 in response to a tactile stimulus, such as an operator pressing inward on the outward-facing "drawer" surface of lower platen 118. In still other embodiments, motor 130 and motion controller 134 may cause lower platen 118 to emerge based on another stimulus, such as pressing of a button or unlocking of a lock.

After the operator secures the product and the transfer media to product platen 126 and lower platen 118 using a clamping system (described in further detail below in association with FIGS. 6 and 7), lower platen 118 may be translated by motor 130 and motion controller 134 to a position aligned in the X and Y directions with heating platen 124. This configuration is illustrated in FIG. 2B. In some embodiments, this position aligned with heating platen 124 may also be pre-programmed into motion controller 134, such that lower platen 118 is reliably moved to the correct position at the beginning of each sublimation task.

In the example shown in FIG. 2B, apparatus 100 brings lower platen 118 and heating platen 124 into contact via press assembly 110 and motion controller 134. The heated platen surface of heating platen 124 is engaged with the transfer media laid atop the product secured in product platen 126. Apparatus 100 may remain in the configuration shown in FIG. 2B for a pre-determined amount of "dwell time" based on properties of the product, or properties of the printed image(s). Instructions to this end may be processed by one or more of user interface device 106 and associated processors, by heater controller 132, and/or motion controller 134.

FIG. 2C illustrates a third stage of a sublimation task. Once the thermal cycle of heating platen 124 is complete, motor 130 and motion controller 134 may translate lower platen 118 to an intermediate stop position between the initial position and the sublimation position. In this third position, product platen 126 is aligned in the X and Y directions with cooling system 114, and the sublimated product may be actively cooled by the cooling system. Meanwhile, apparatus 100 may de-energize heating platen 124 via heater controller 132, either completely or to an intermediate holding temperature as discussed above. Once the cooling step is completed (based on product-specific cooling parameters introduced in some manner to apparatus 100 as described above), motor 130 and motion controller 134 may translate lower platen 118 back to the initial position shown in FIG. 2A, and the operator may remove the cooled, sublimated product and provide it to the consumer.

Figure 3:
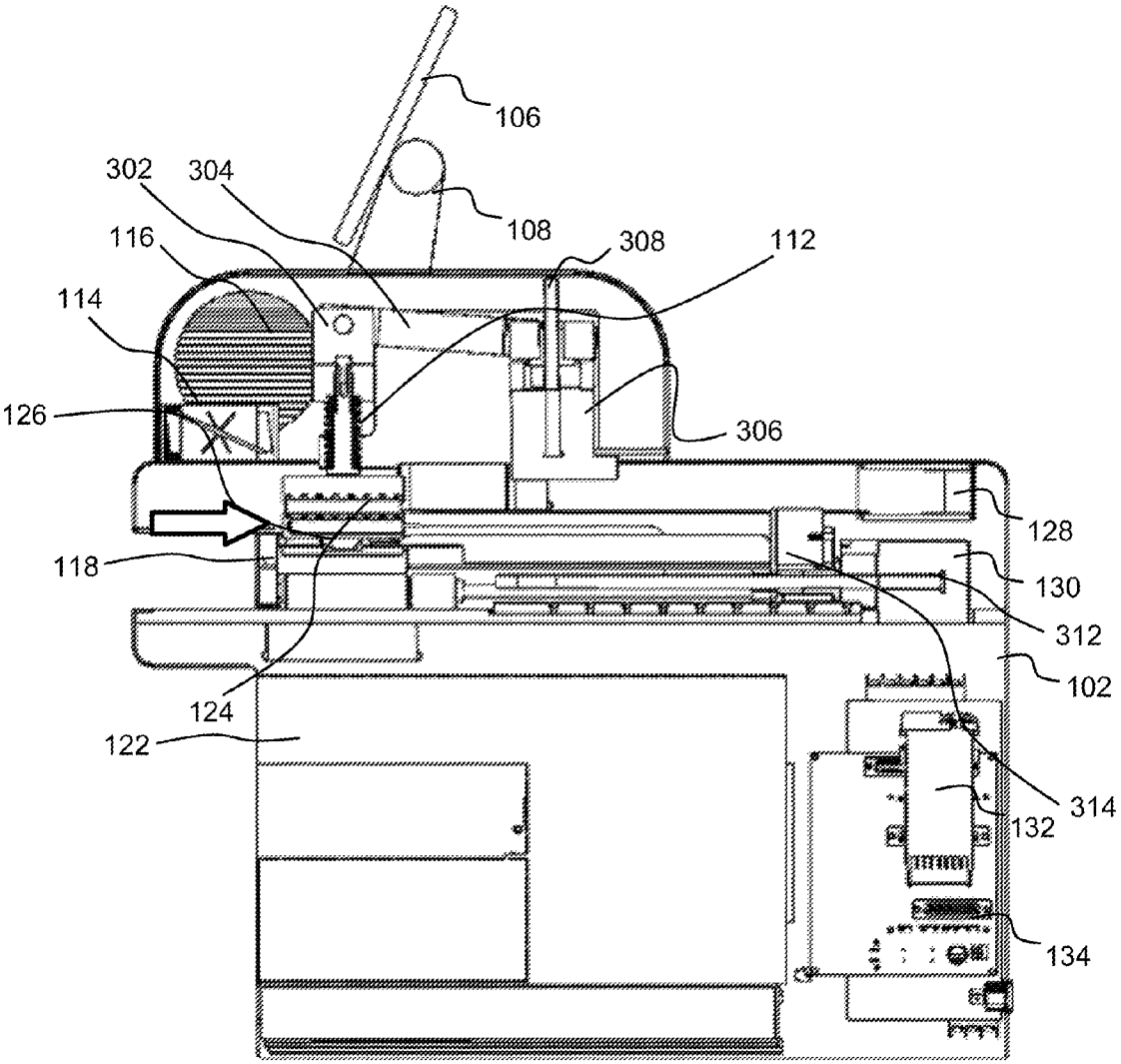
FIG. 3 is a pictorial cross-sectional view of FIG. 2B showing additional detail, consistent with disclosed embodiments.

FIG. 3 is a pictorial cross-sectional view of the illustration of apparatus 100 described above in association with FIG. 2B. In this configuration, apparatus 100 is in the middle of a sublimation task. The cross-sectional view of FIG. 3 provides more details on other components of apparatus 100.

In FIG. 3, reference labels 302, 304, 306, and 308 refer to components of the screw-driven, lever-action press assembly 110 that are not otherwise visible. Guided spring plate assembly 302 provides an interface between components of press assembly 110 and heating platen 124 via springs 112. Assembly 302 transfers force exerted by other components of press assembly 110 to heating platen 124 via springs 112.

Fulcrum plate 304 is a pivotable lever arm connecting guided spring plate assembly 302 to the components of press assembly 110 that produce and provide force: motor 306 and drive screw 308. As motor 306 (via motion controller 134) provides propulsive force upward in the Z-direction, drive screw 308 translates upward. This movement in turn exerts force onto one end of fulcrum plate 304, which results in an eventual transfer of the force to the opposite end. In this manner, fulcrum plate 304 works as a lever arm, or a children's see-saw. The force from motor 306 is then driven downward through guided spring plate assembly 302 and into heating platen 124 to produce the 30-40 psi needed to properly sublimate the printed image from the transfer media to the product. This may amount to 300-400 lbs of equivalent downward force. Accordingly, lower platen 118 and product platen 126 must be manufactured in a manner and of a material capable of withstanding these forces.

Motor 306 may be configured to reverse its motion. In response to a signal transmitted by motion controller 134, motor 312 may be capable of retracting drive screw 308 to reverse the force transduction through press assembly 110 and separate heating platen 124 and lower platen 118.

FIG. 3 also provides a cross-sectional view of motor 130, illustrating horizontally-oriented drive screw 312. Much in the manner described above in relation to motor 306, when activated by motion controller 134, motor 130 propels drive screw 312 to translate the position of lower platen 118. In some embodiments, this motion may include translating lower platen 118 on and off of a "ramp"-like structure, particularly when lower platen 118 is in the "sublimation position" illustrated in FIG. 2B and FIG. 3. This "ramp" (not shown in FIG. 3) may provide additional structural stability to lower platen 118 so it can withstand the pressure exerted by press assembly 110.

As in the case of motor 306, motor 130 may be configured to reverse its motion upon a signal transmitted by motion controller 134. This reversible motion enables the bidirectional translation of lower platen 118. Also included along the "track" of lower platen 118 are various safety interlock features 314, which may prevent lower platen 118 from being translated by motor 130 and drive screw 312 past a certain point in the Y direction. These safety features prevent damage to apparatus 100 and provide additional safety for an operator and/or a consumer.

Figure 4:
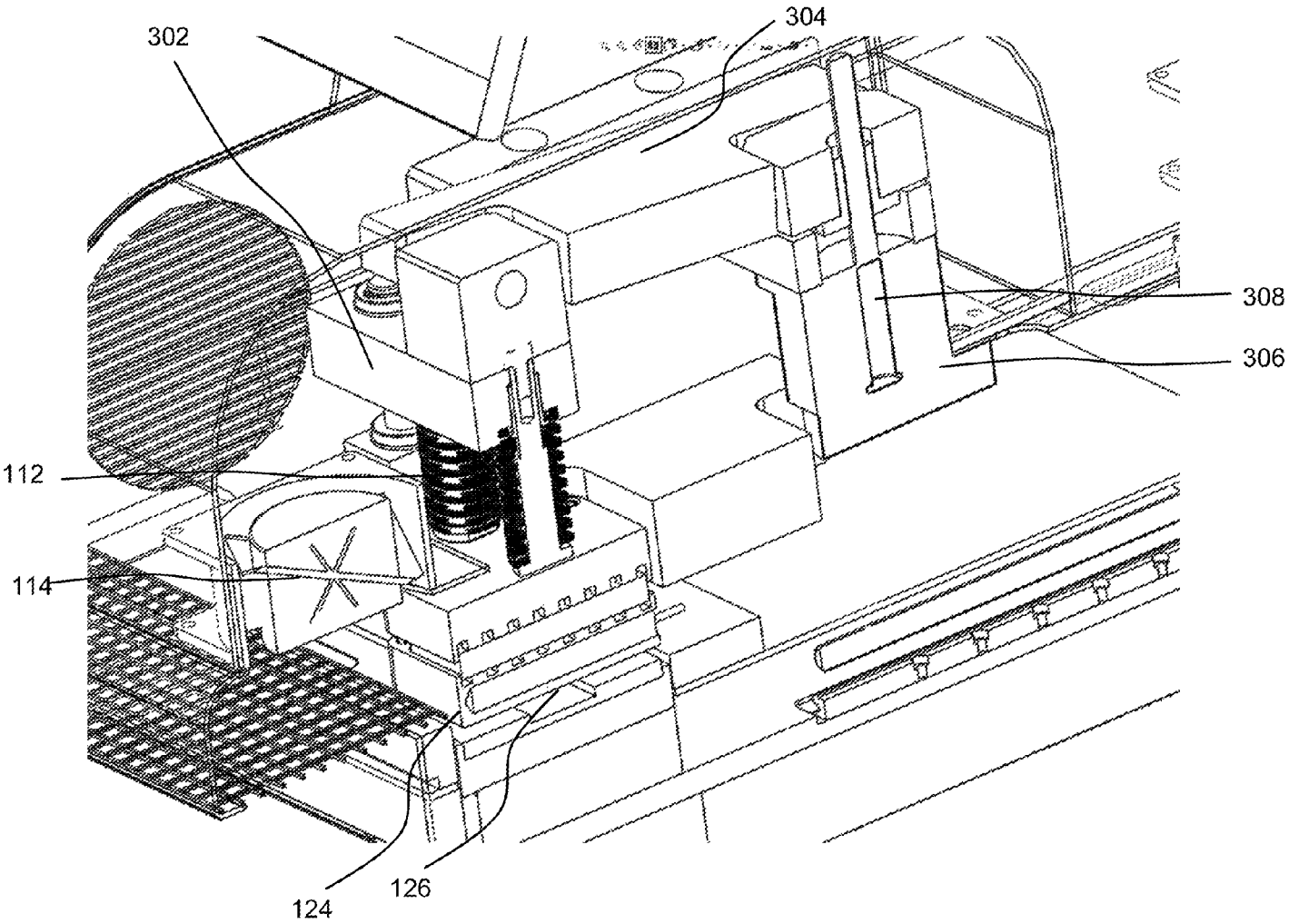
FIG. 4 is a detailed profile cutaway view of a portion of the dye sublimation transfer printing apparatus of FIGS. 1A-1C, consistent with disclosed embodiments.

FIG. 4 provides a different perspective view of the components described above in association with FIG. 3, particularly elements 302-308 of press assembly 110. This perspective illustrates how the force generated by motor 306 may be transferred through press assembly 110 and applied to heating platen 124 so it may sublimate a product (not shown) secured in product platen 126.

Figure 5A:
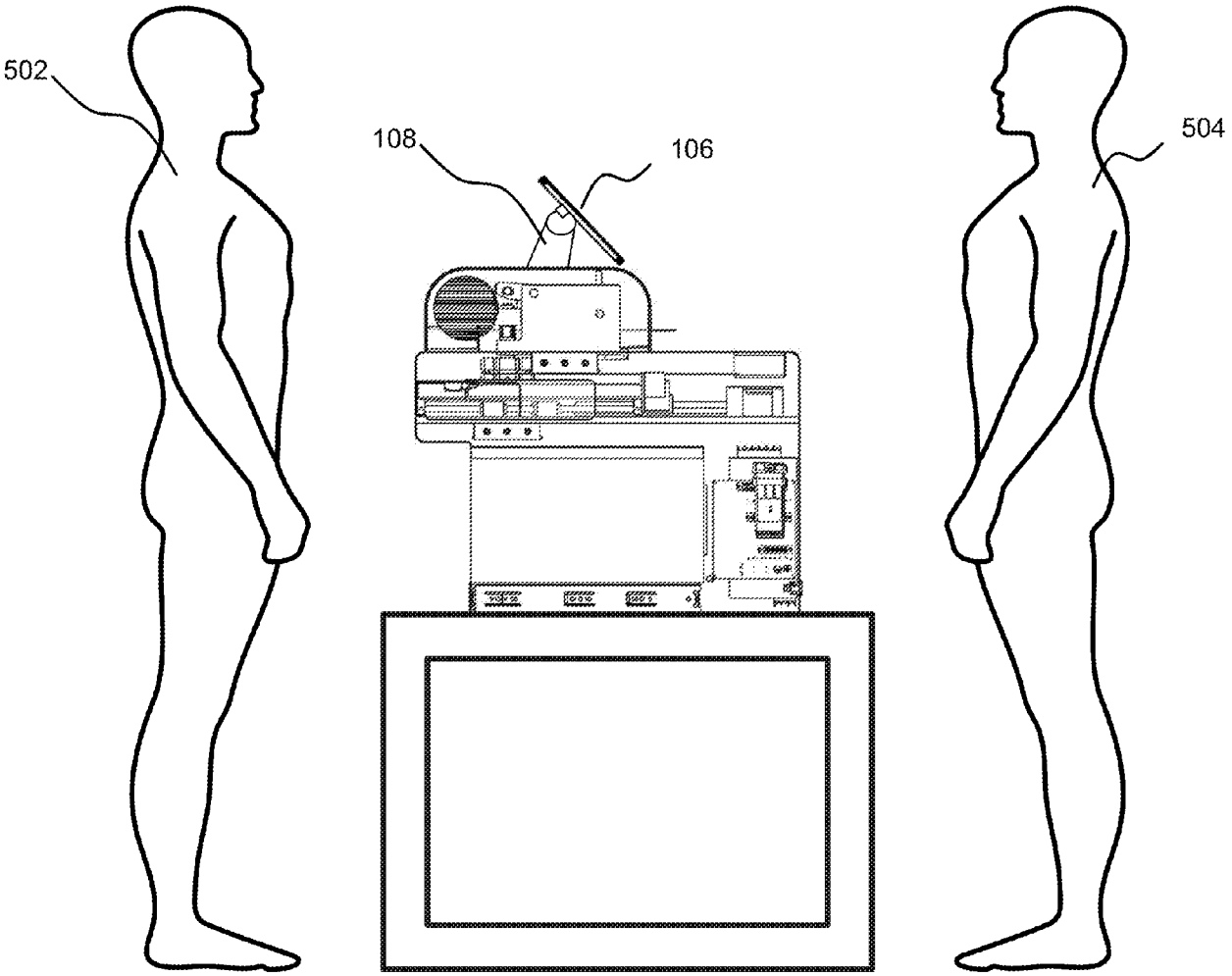
FIGS. 5A-5B illustrate operator-facing and consumer-facing embodiments of the dye sublimation transfer printing apparatus of FIGS. 1A-1C, consistent with disclosed embodiments.
Figure 5B:
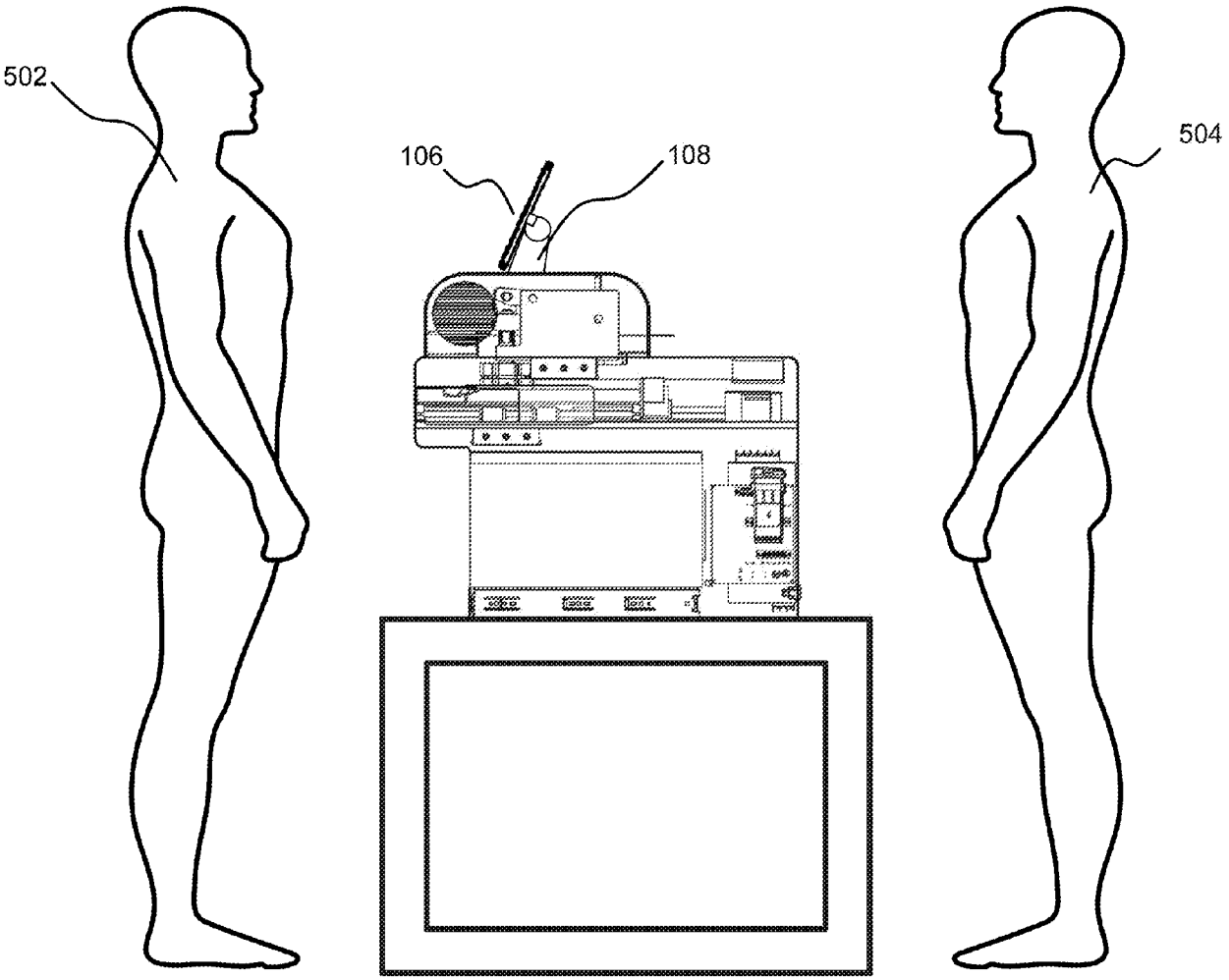

FIGS. 5A and 5B illustrate typical operation of apparatus 100 by an operator 502 and a consumer 504. As discussed above, operator 502 may be a clerk, associate, employee, etc. of a retail establishment hosting apparatus 100. In some embodiments, operator 502 may be an employee of the entity that manufactures apparatus 100. In still other embodiments, operator 502 may be an independent contractor or an employee employed by a third entity unaffiliated with either the previously-described host entity or manufacturing entity. Consumer 504 may represent a customer of a retail establishment interested in purchasing a personalized sublimated product.

In the example illustrated in FIG. 5A, apparatus 100 is configured in a manner where user interface device 106 has been rotated on screen mount 108 such that the screen of user interface device 106 is visible and operable by consumer 504. Apparatus 100 may be configured in this alignment when input or decisions are required of consumer 504, such as during selection of a product, selection of a design to be sublimated onto the product, entry of additional textual information such as names, addresses, etc., confirmation, and/or payment.

In FIG. 5B, apparatus 100 is configured in a manner where user interface device 106 has been rotated on screen mount 108 such that the screen of user interface device 106 is visible and operable by operator 502. Apparatus 100 may be configured in this alignment when input or decisions are required of operator 502, such as during initial apparatus access, during product loading (into product platen 126), and during the sublimation and cooling tasks.

Figure 6:
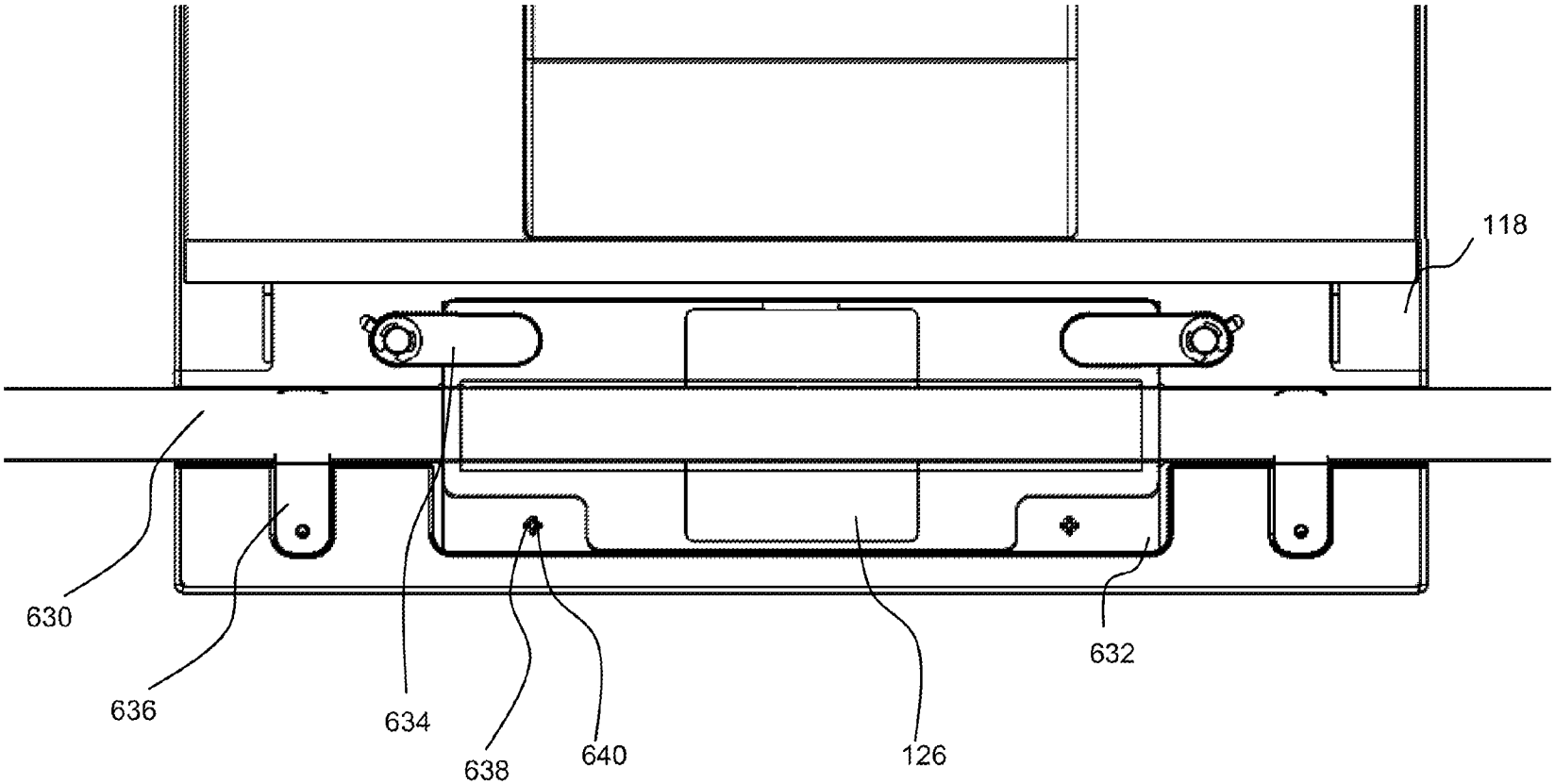
FIG. 6 is a top view of the lower platen of the dye sublimation transfer printing apparatus of FIGS. 1A-1C in the product loading position, consistent with disclosed embodiments.
Figure 7:
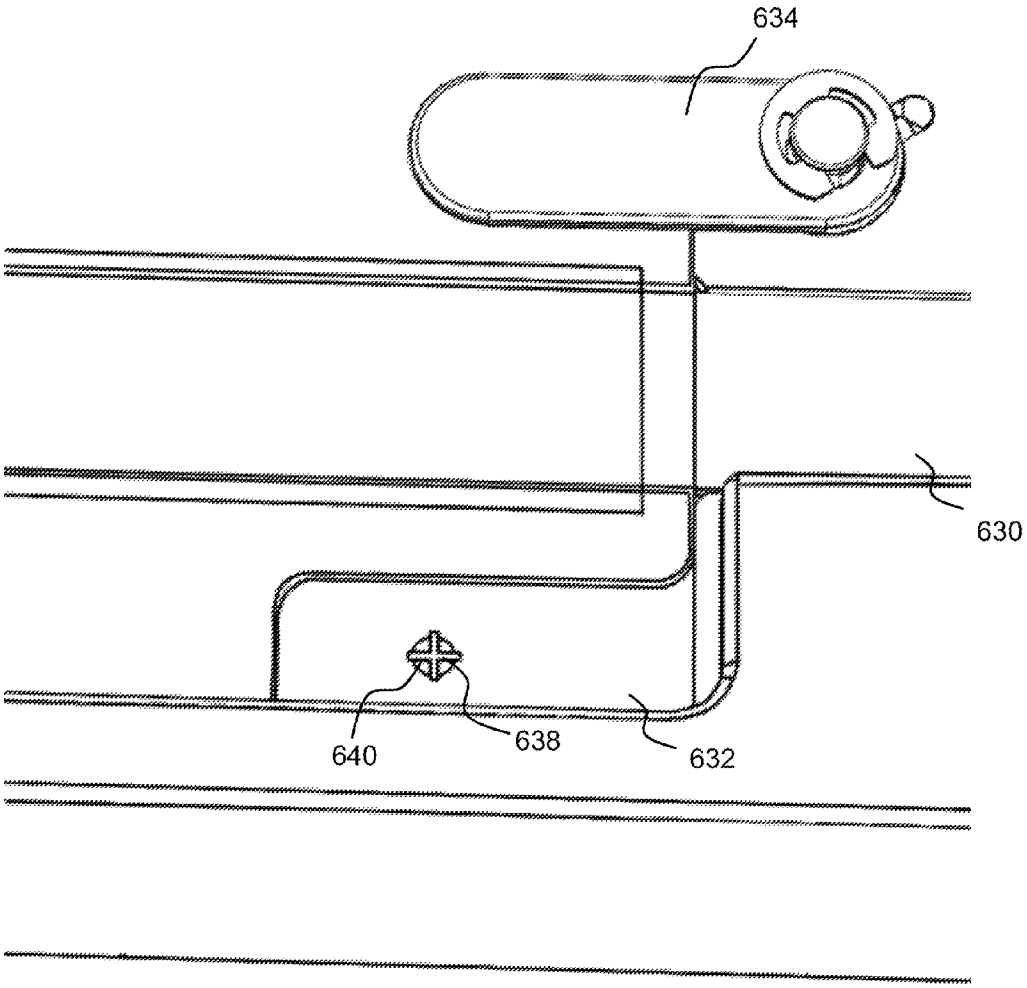
FIG. 7 is a more detailed view of FIG. 6, consistent with disclosed embodiments.

FIGS. 6 and 7 illustrate additional detail of lower platen 118, product platen 126, and the alignment and securing of a product and the printed transfer media. In the illustration shown in FIG. 6, a product 630 (here, a pet leash) is being loaded into product platen 126 by an operator 502 in preparation for a sublimation task. A sheet of transfer media 632 has been overlaid on top of product 630 within product platen 126, and is clamped to product platen 126 via transfer media clamps 634. In alternative embodiments, product 630 may be laid on top of transfer media 632. Product 630 is itself clamped to product platen 126 via clamps 636. Clamps 634 and 636 may be spring-loaded, or may be clamped and secured via thumb screws or some sort of other reversible system. As can be seen in FIG. 6, product 630 is situated within a dedicated channel of product platen 126 configured to precisely fit that type of product. The rectangular channel of product platen 126 in the center portion of the platen is unused in this illustration, but could be utilized in a different sublimation task to sublimate tags, plaques, etc. as described above.

In some embodiments, the transfer media 632 may contain one or more printed indicia and/or fiducial markers 638. Proper alignment of product 630 and the transfer media 632 in a sublimation printing apparatus such as apparatus 100 described above is particularly important. Even a slight misplacement of the product 630 or the transfer media 632 may result in poor quality of the sublimated image and thus a defective sublimated product that wastes time and money for the retail establishment. Proper alignment of the transfer media 632 in a sublimation printing apparatus such as apparatus 100 is particularly important when the apparatus is configured to print on more than one side of a product 630 substantially simultaneously. Proper alignment of the product 630 and transfer media 632 may also be important to prevent hazards, such as overheating of the transfer media 632. Even slight overheating of transfer media 632 may create unpleasant odors that could irritate the operator 502 and other surrounding consumers, such as consumer 504.

Therefore, in some embodiments, alignment of the product 630 and the transfer media 632 within product platen 126 and lower platen 118 may be additionally facilitated by lights 640. Lights 640 may be disposed on or in product platen 126, lower platen 118, or both.

Further detail of the interplay between fiducial markers 638 and lights 640 is shown in FIG. 7. One or more lights 640 may be configured to illuminate when lower platen 118 is translated to the "initial" loading position illustrated in FIG. 2A. In alternative embodiments, lights 640 may be illuminated at all times that apparatus 100 is operational. When lights 640 are illuminated, they permit operator 502 to place fiducial markers 638 printed on transfer media 632 wholly within the circumference of light 640, ensuring proper alignment. Lights 640 are disposed on product platen 126/lower platen 118 at precise positions to ensure alignment with product. In some embodiments, a particular apparatus 100 may be configured with multiple sets of lights 640 to facilitate different spatial arrangements on product platen 126 for different products 630 and transfer media 632. In other embodiments, apparatus 100 may have only a single set of lights 640. In some embodiments, fiducial markers 638 may be printed onto transfer media 632 by printer 122, and their locations on transfer media 632 may be variable for each printing task based on the printed image and based on the dimensions of the product 630 to be sublimated. In other embodiments, the sheets of transfer media 632 may be pre-printed at the factory with fiducial markers 638.

Figure 8:
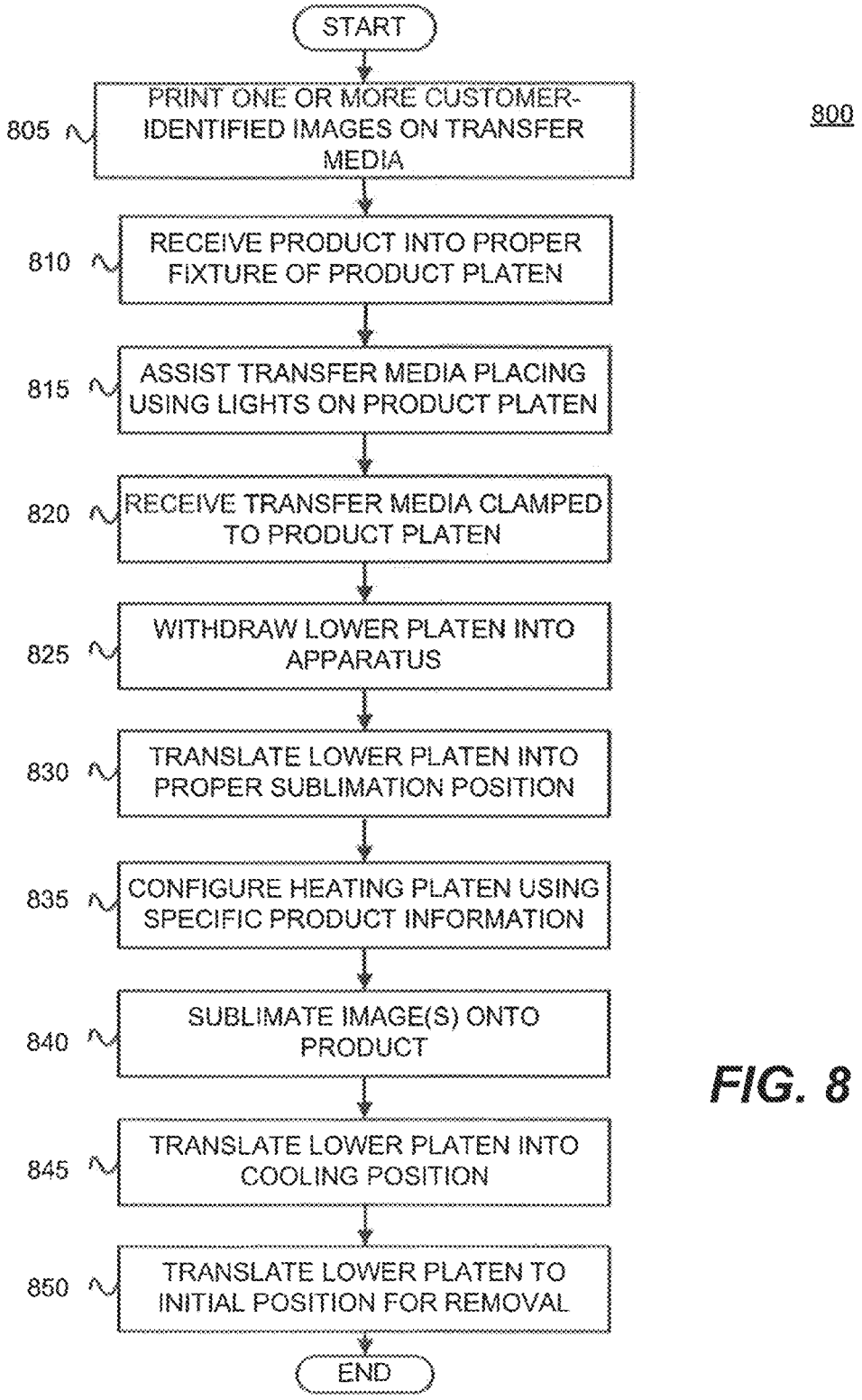
FIG. 8 is a flowchart of an exemplary dye sublimation transfer printer apparatus operation process, consistent with disclosed embodiments.

Apparatus 100 may be configured to perform a sublimation process 800, such as that shown in the example of FIG. 8. In one embodiment, a printer associated with apparatus 100, such as printer 122, may be configured by apparatus 100 via user interface device 106 to print one or more consumer-identified images onto a sheet of transfer media 632 (Step 805). In some embodiments, the image(s) may be a consumer-provided image received through user interface device 106. In other embodiments, the image(s) may be stock images preloaded into the memory of user interface device 106. In still other embodiments, the image(s) may constitute text input received by device 106. In yet other embodiments, the image(s) may be captured by a camera associated with device 106. The image(s) may also represent a combination or composite of the above described options, as will be shown in further detail below in association with FIGS. 12-14. In some embodiments, apparatus 100 may be configured to begin other sublimation operations in conjunction with the printing of the transfer media. For example, heater controller 132 and thermal management unit 128 may begin heating of heating platen 124 to a proper sublimation temperature for the particular product 630 that has been selected by consumer 504 once printer 122 begins printing the selected images onto transfer media 632.

Based on the selection of a sublimatable product 630 by consumer 504 via user interface device 106, apparatus 100 may receive the selected product 630 into the proper channel of product platen 126 by manual placement from operator 502. Alternatively, operator 502 may introduce a detachable product platen 126 specially configured to be associated with the selected product 630, or a separate dedicated modular fixture as described above into lower platen 118 (Step 810). A separate modular fixture may be used for certain types of product 630, such as three-dimensional products. Using these fixtures, irregularly-shaped items such as coffee mugs, pet food bowls, Christmas ornaments, or other such items may be successfully sublimated within apparatus 100.

Apparatus 100 may next assist with the placement and alignment of the printed transfer media 632 onto product platen 126 using the system components described above in association with FIGS. 6 and 7, including lights 640 (Step 815). By assisting with the alignment of the fiducial markers 638 of transfer media 632 with lights 640, the selected product 630 may be properly aligned with the images for sublimation printed on the transfer media 632. Once aligned using the backlit system, apparatus 100 may receive the transfer media 632 by activation of clamps 634 (Step 820). In some embodiments, one or more of the processors or controllers described above may be configured to sense that clamps 634 have been activated.

Once the product 630 and transfer media 632 are properly aligned and secured within product platen 126, lower platen 118 may be withdrawn into apparatus 100 (Step 825). As described above, in some embodiments, lower platen 118 may be withdrawn with the assistance of an operator 502, via a tactile pressing motion. In other embodiments, a button press either on a virtual keyboard displayed on user interface device 106 or an actual physical button disposed on lower platen 118 or housing 102 may initiate the withdrawal process. In still other embodiments, apparatus 100 may be configured to sense that all components are aligned and ready for sublimation, and may automatically withdraw lower platen 118.

In Step 830, apparatus 100 may translate lower platen 118 into the proper "sublimation position" along its track (see FIG. 2B) via motor 130 and motion controller 134 as described above. Subsequently or concurrently, heater controller 132 and thermal management unit 128 may configure the single thermal cycle for heating platen 124 using specific product information for product 630 as discussed above. Heater controller 132 and thermal management unit 128 may receive the specific product information in various ways, such as by scanning of an indicia on product 630, or by accessing a stored "profile" for the product 630 containing the information via user interface device 106. Heater controller 132 may process the software instructions associated with the specific product information and may use the instructions to configure the thermal cycle. Based on the thickness, dimensions, and material composition of product 630 (or other factors, as needed), heater controller 132 (and/or motion controller 134, as needed) may determine the particular temperature, pressure, and dwell time needed to successfully complete the sublimation task.

Once the thermal cycle is configured, process 800 continues with motion controller 134 and press assembly 110 engaging heating platen 124 and lower platen 118 (Step 840). Once contact is made, the thermal cycle is executed with the previously configured temperature, pressure, and dwell time, thus sublimating the one or more printed images of transfer media 632 onto one or more sides of the product 630.

When the sublimation is complete, apparatus 100, via motor 130 and motion controller 134, may translate lower platen 118 back to its intermediate "cooling position" (see FIG. 2C) (Step 845). Via cooling system 114, apparatus 100 may cool the sublimated product 630 to at least about an ambient temperature. As discussed above, apparatus 100, via motion controller 134 and safety interlocks 316, may be configured to limit access to the sublimated product 630 until the product has sufficiently cooled. The cooling time required may vary by type of product 630 used, and this cooling time may be included within the specific product information introduced into apparatus 100.

Once the sublimated product 630 has cooled to at least about an ambient temperature, apparatus 100, via motor 130 and motion controller 134, may translate lower platen 118 back to its initial position (see FIG. 2A) (Step 850). At this point, lower platen 118 and product platen 126 are again accessible by operator 502, and operator 502 may remove the sublimated product 630 and provide it to consumer 504. In some embodiments, as described above, user interface device 106 may facilitate and receive payment for the product 630, or may alternatively provide consumer 504 with a printed ticket or receipt to facilitate payment at another location.

In some embodiments, apparatus 100 may be alternatively configured such that product 630 is provided to apparatus 100 within a cassette, which may enable even more accurate and reliable alignment of the product. In some embodiments, product 630 may be affixed to or installed within the cassette at the factory. In other embodiments, the cassette may be reusable, and product 630 may be installed within the cassette by a clerk or a consumer at the time of customization. In embodiments such as these where transfer media is utilized, the transfer media may be included within the cassette, or may be added later. The use of a cassette may enable either a clerk or a consumer to operate apparatus 100 safely and effectively.

Figure 9A:
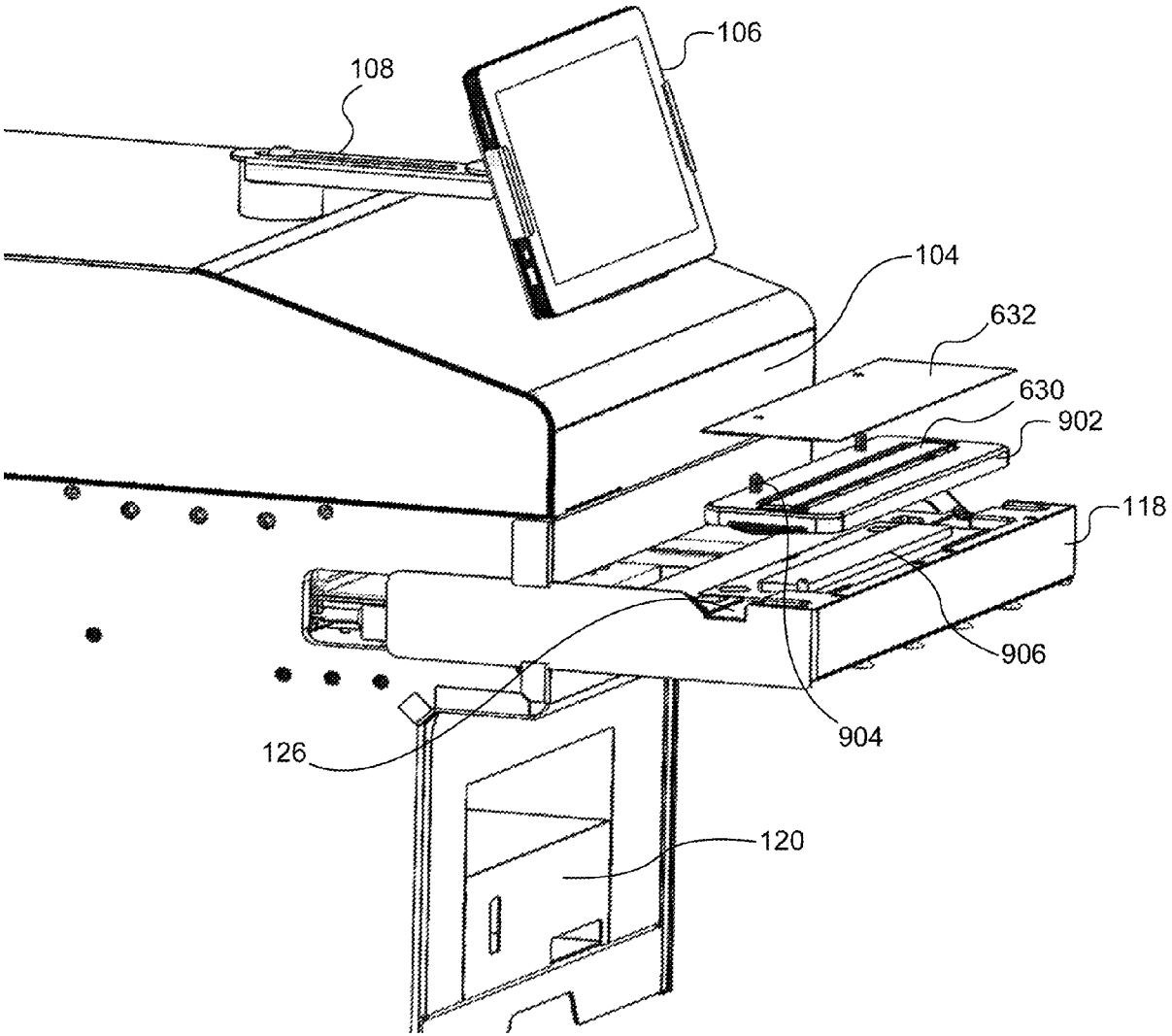
FIG. 9A is an exploded view of a cassette for streamlined alignment of a product within a sublimation apparatus, consistent with disclosed embodiments.
Figure 9B:
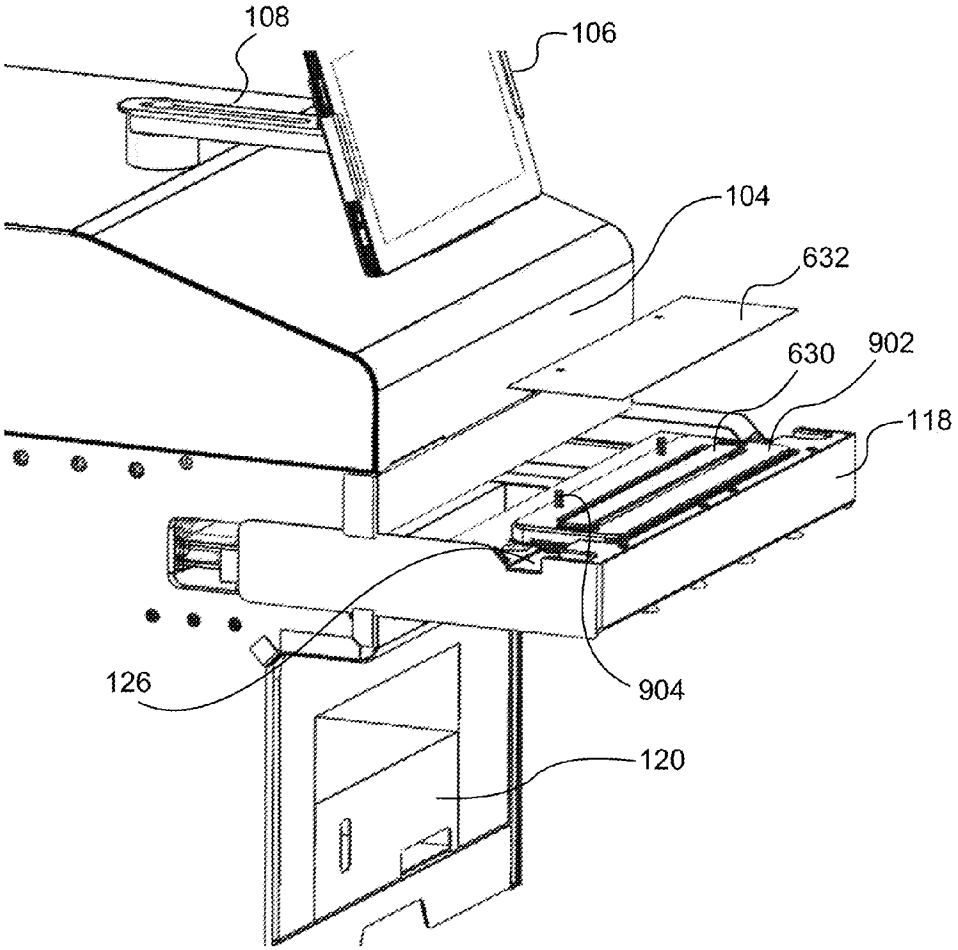
FIG. 9B is an exploded view of a cassette for streamlined alignment of a product within a sublimation apparatus, consistent with disclosed embodiments.
Figure 9C:
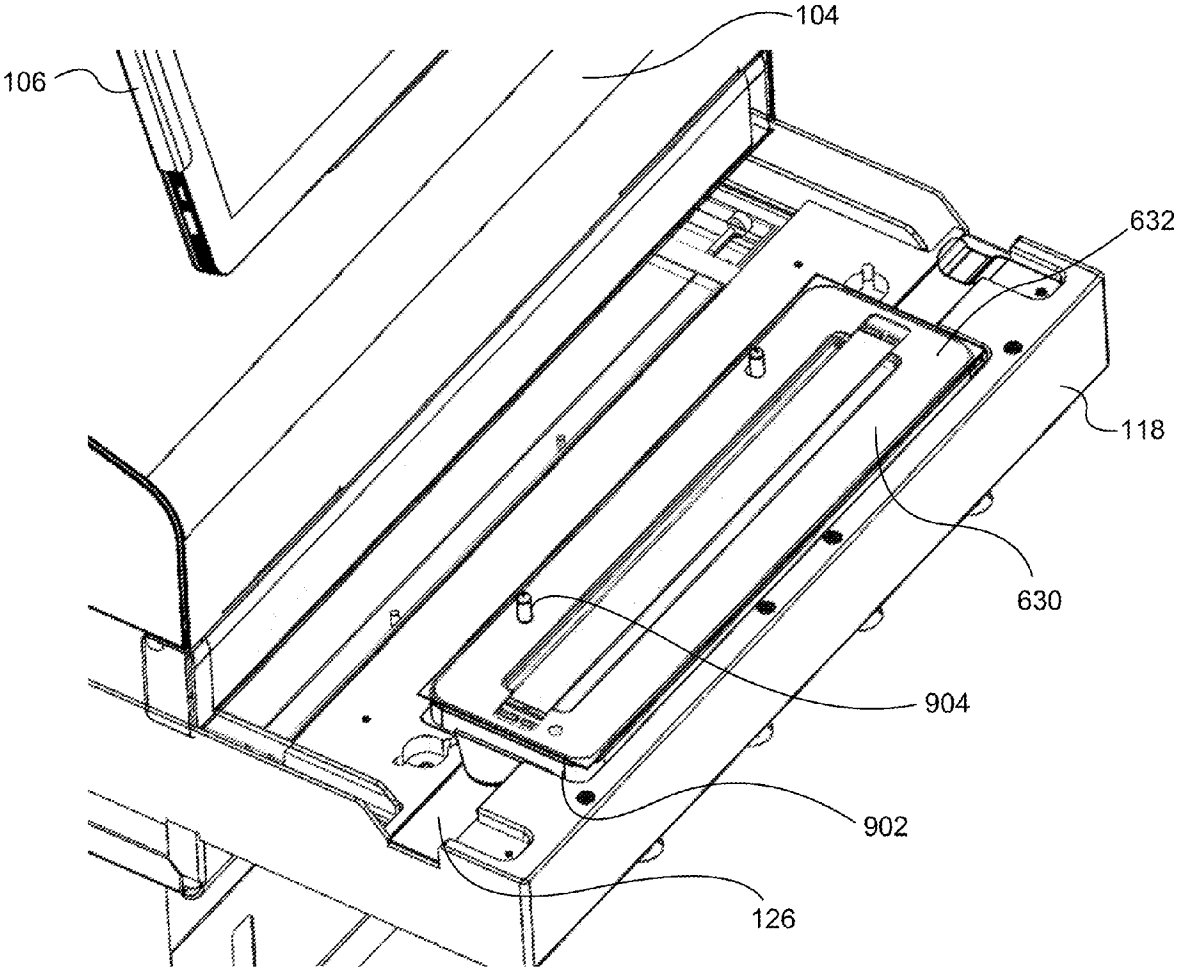
FIG. 9C is a pictorial view of a cassette for streamlined alignment of a product successfully aligned within a sublimation apparatus, consistent with disclosed embodiments.

FIGS. 9A-9C illustrate a cassette-equipped embodiment of apparatus 100. FIG. 9A shows an apparatus 100 similar to that illustrated above in association with FIGS. 1A-7, but configured to accept a cassette within lower platen 118 and/or product platen 126. In the illustration of FIG. 9A, lower platen 118 is in its "open" position to accept a product for sublimation, similar to the view of apparatus 100 illustrated in FIG. 2A. An exploded view of a cassette 902 is shown. Cassette 902 comprises a pre-affixed product 630, as well as alignment implements 904. A sheet of transfer media 632 is also shown, with pre-punched holes that align with alignment implements 904. In direct printing embodiments that do not require the use of transfer media 632, transfer media 632 may not be included or otherwise associated with cassette 902. In these embodiments, product platen 126 includes a cassette interface 906, which receives cassette 902 in a pre-aligned position for sublimation. The apparatus 100 shown in FIG. 9A therefore may not be equipped with lights 640, since the use of cassette 902 and cassette interface 906 streamlines the alignment process. The use of cassette 902 and cassette interface 906 may be useful, for example, in consumer-operated embodiments of apparatus 100 where a clerk or other operator (such as operator 502) is not present to run the machine. Consumer 504 thus may be enabled to conduct a full sublimation task themselves without outside assistance.

FIG. 9B illustrates the same apparatus 100 as FIG. 9A, but with cassette 902 coupled to cassette interface 906 (not visible in FIG. 9B). In these embodiments, apparatus 100 may provide feedback to the operator (either operator 502 or consumer 504) indicating that cassette 902 is properly associated with cassette interface 906. In some embodiments, a tactile or visible mechanical response may be provided, such as a click, a button, a flag, or a tab indicating that cassette 902 is properly situated. In other embodiments, user interface device 106 may be configured to provide audio and/or visual feedback to the operator indicating that cassette 902 is properly associated with cassette interface 906, or the opposite.

FIG. 9C is a detailed view of the entire cassette 902 and transfer media 632 situated within product platen 126. Transfer media 632 (printed with images to be sublimated on its opposing face (not shown)) is aligned on top of alignment implements 904 of cassette 902. Alignment implements 904 are illustrated as pegs in FIGS. 9A-9C, but may be any other type of mechanical implement that facilitates alignment of the transfer media. In embodiments where apparatus 100 is a direct sublimation apparatus, alignment implements 904 may be absent, since no transfer media 632 is required. In the illustration of FIG. 9C, lower platen 118 is now ready to be withdrawn into apparatus 100 for the sublimation task, such as shown in FIG. 2B. The operator of apparatus 100, be it operator 502 or consumer 504, may indicate to apparatus 100 that the task is ready to proceed via input into user interface 106. In some embodiments, apparatus 100 may be configured to automatically sense either that cassette 902 is properly situated within product platen 126, that transfer media 632 is properly aligned within cassette 902, or both. In these embodiments, apparatus 100 may be configured to prompt the operator to perform actions via user interface device 106. Apparatus 100 may be further configured to automatically withdraw lower platen 118 when it senses that cassette 902 and (where present) transfer media 632 are properly situated and aligned.

Figure 10:
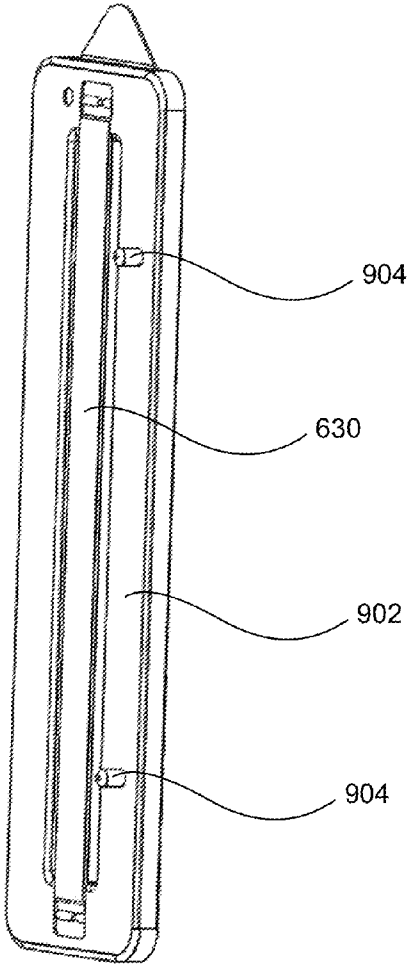
FIG. 10 is a detailed view of a cassette for streamlined alignment of a product within a sublimation apparatus, consistent with disclosed embodiments.

FIG. 10 is a detailed view of cassette 902. In the example of FIG. 10, product 630 is a pet collar or lead, and is affixed to cassette 902 at its ends. As discussed above, in some embodiments cassette 902 may be configured for a single use, and may be associated with product 630 at the factory. In these embodiments, cassette 902 may be printed or otherwise associated with an indicia, such as a barcode, which will permit the item to be purchased and paid for prior to initiating the sublimation task. The indicia may be printed directly on cassette 902, or may be printed onto exterior packaging for cassette 902 (not shown in FIG. 10). In these embodiments, apparatus 100 may be configured to accept payment for product 630 (and cassette 902) via user interface device 106. Further, user interface device 106 may be configured to require and receive entry of a verification code by operator 502 to confirm that product 630 was paid for via one or more graphical user interfaces, examples of which will now be described in detail.

Figure 11:
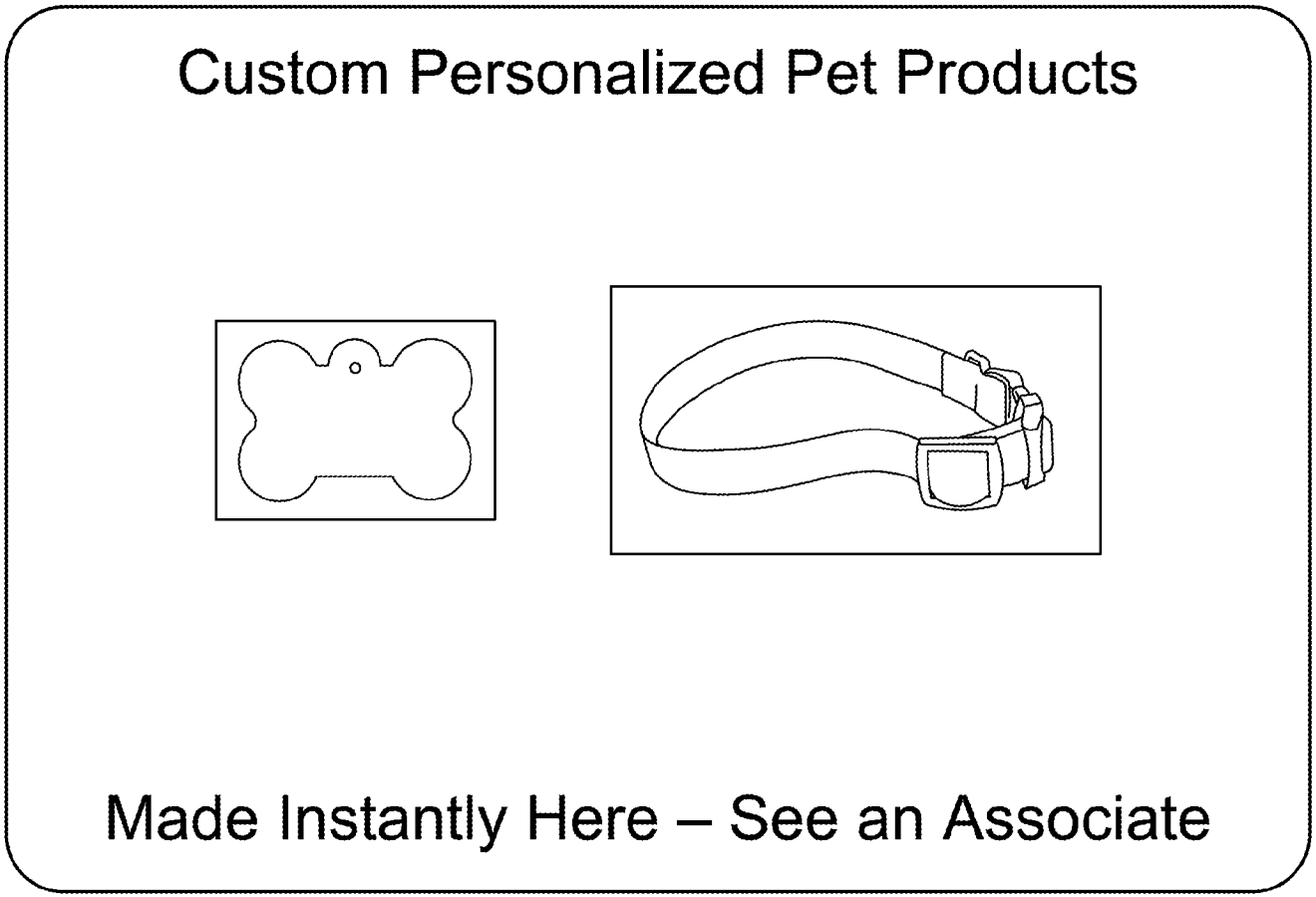
FIG. 11 is an example user interface associated with a sublimation apparatus for attracting consumers to the apparatus, consistent with disclosed embodiments.

FIGS. 11-18 are example graphical user interfaces (GUIs) that may be provided by the disclosed embodiments to facilitate interaction with a user. In these embodiments, user interface device 106 of apparatus 100 may display the GUIs to the user via a touchscreen display. FIG. 11 is an example GUI that may be configured to initiate contact with a user. For example, the GUI of FIG. 11 may be constantly displayed on user interface device 106, with screen mount 108 rotated out such that the GUI is visible to passing consumers within the retail location, as in the example illustrated above in association with FIG. 5A. In these embodiments, the GUI of FIG. 11 may act as a "screensaver," and as a constant, low-cost form of advertising for the kiosk. In some embodiments, additional advertisements or messages may be displayed on the screen of user interface device 106 in addition to the GUI of FIG. 11. These messages may include, but not be limited to, advertisements related to other products or departments within the retail establishment hosting apparatus 100, advertisements related to the entity that owns or manufactures apparatus 100, or messages advertising special deals or offers.

Figure 12:
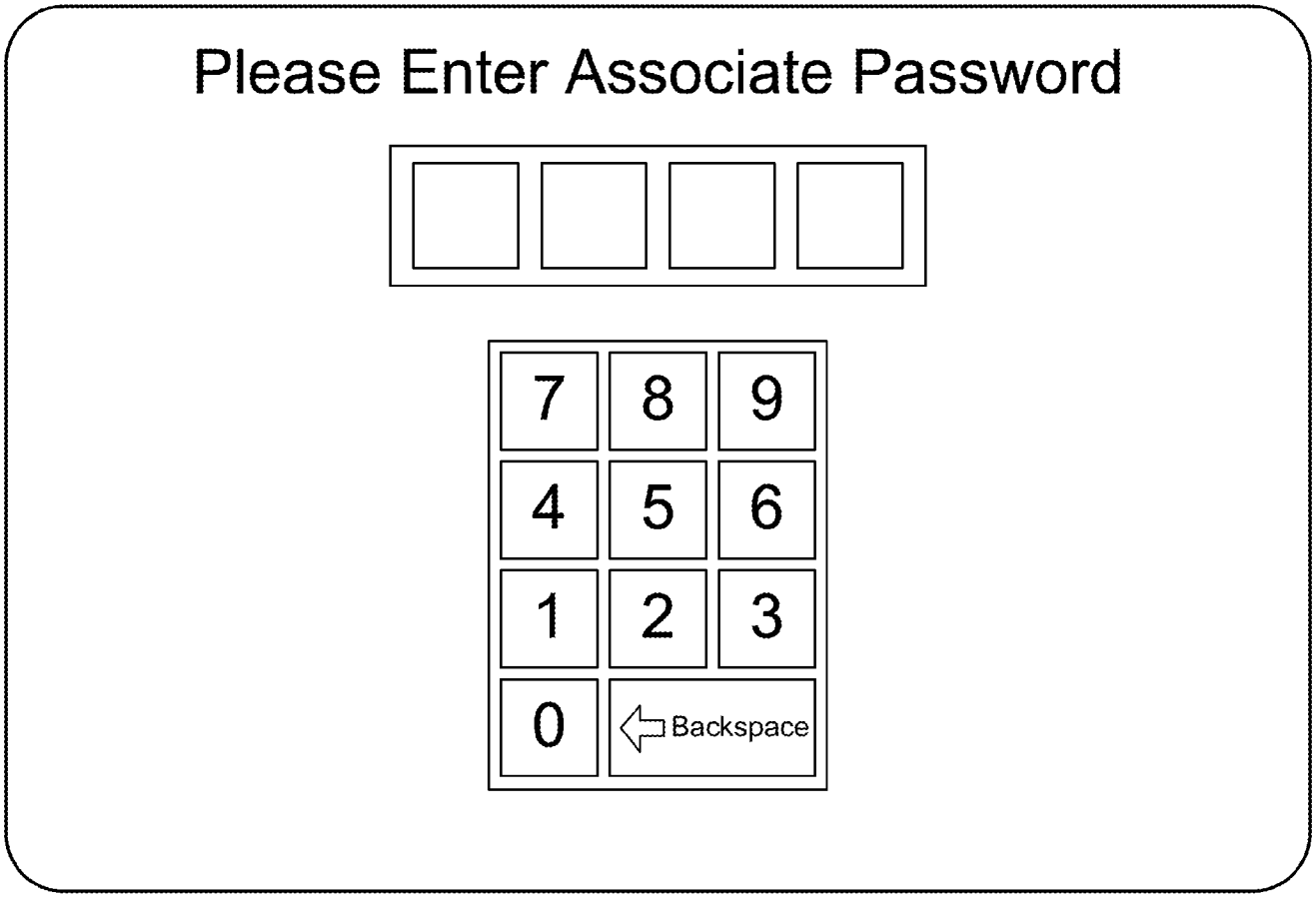
FIG. 12 is an example user interface associated with a sublimation apparatus for facilitating controlled access to the apparatus by an operator, consistent with disclosed embodiments.

FIG. 12 is an example GUI that may be configured to assist a retail employee, such as a clerk, associate, or other operator, in accessing the system controls. FIG. 12 illustrates a screen where the operator may enter a previously assigned password or other such security credential (including but not limited to biometrics, scanning of a badge, swiping of a card, etc.) in order to proceed further with system configuration and with sublimation tasks. Securing apparatus 100 in this manner ensures the safety of consumers and prevents unauthorized operation of the apparatus or accidental contact with system components. The example GUI in FIG. 12 may be displayed on user interface 106 when screen mount 108 is rotated such that it is facing the operator, as in the example described above in association with FIG. 5B. In some embodiments, each operator authorized to operate apparatus 100 may be assigned their own unique password. In other embodiments, each individual apparatus 100 may be configured such that access may be achieved by a single global password or security credential shared among all authorized operators. In some embodiments, the assigned password or security credential may be static for the life of apparatus 100; in other embodiments, the password or security credential may be changed periodically in order to enhance security.

Figure 13:
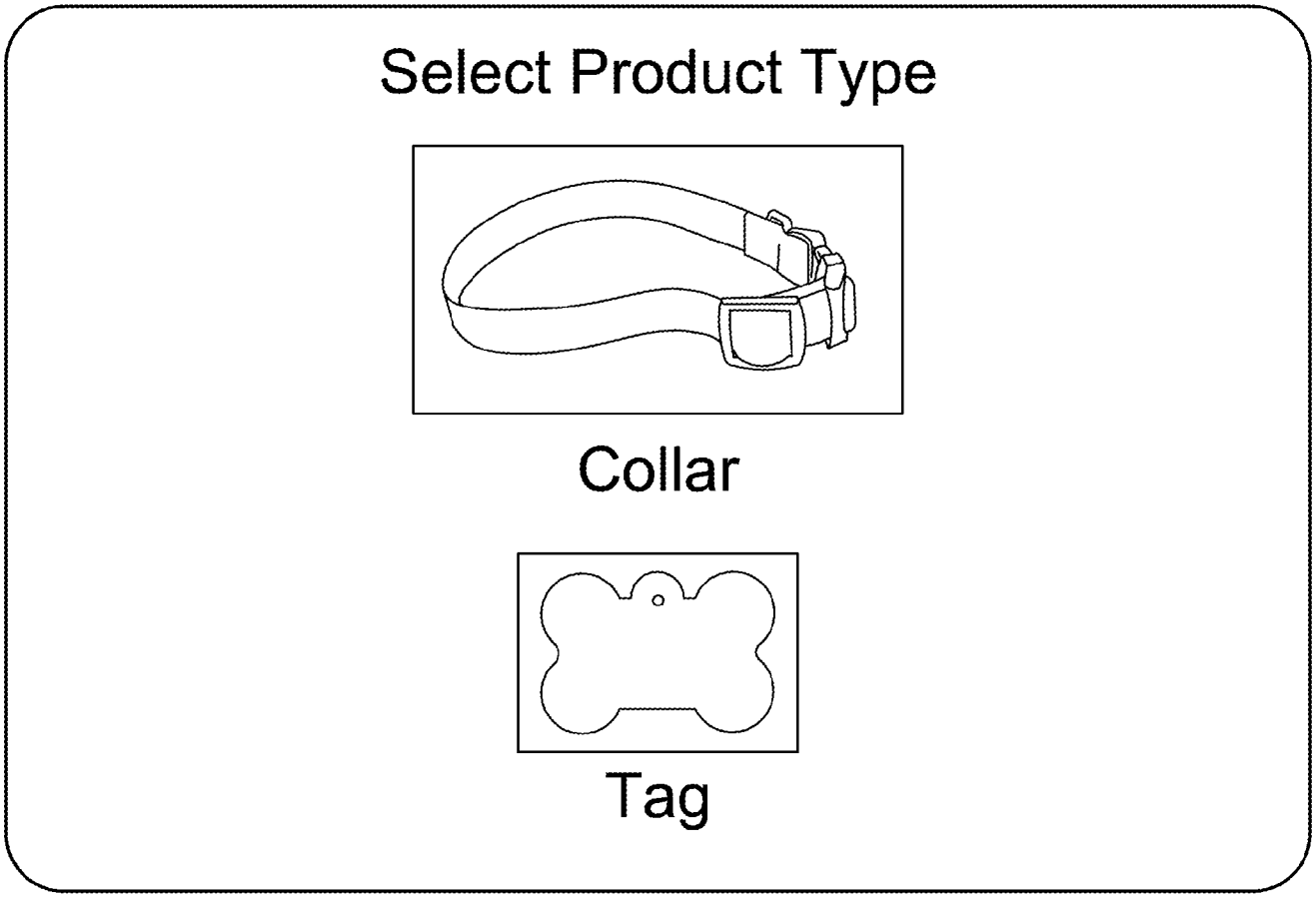
FIG. 13 is an example user interface associated with a sublimation apparatus for selecting one of a plurality of different types of products to be sublimated, consistent with disclosed embodiments.

FIG. 13 is an example GUI that may be configured to assist a user in selecting one of a plurality of different types of products to be sublimated. Depending on the configuration of user interface device 106, the different options illustrated as square boxes in FIG. 13 such as "Collar" and "Tag" may be operable as touchscreen buttons, or may be selectable using an optional mouse/trackball and/or keyboard associated with user interface device 106. In some embodiments the example GUI of FIG. 13 may be displayed when screen mount 108 is rotated to face the consumer, such as in FIG. 5A. In alternative embodiments, the GUI of FIG. 13 may be displayed when screen mount 108 is rotated to face the operator, such as in FIG. 5B, and the operator may prompt the consumer to indicate the desired product. In direct printing embodiments, the options available for selection on the GUI of FIG. 13 may indicate that the product is configured for direct printing; or alternatively, that an operator may need to apply a coating for facilitating direct printing once selected.

Figure 14:
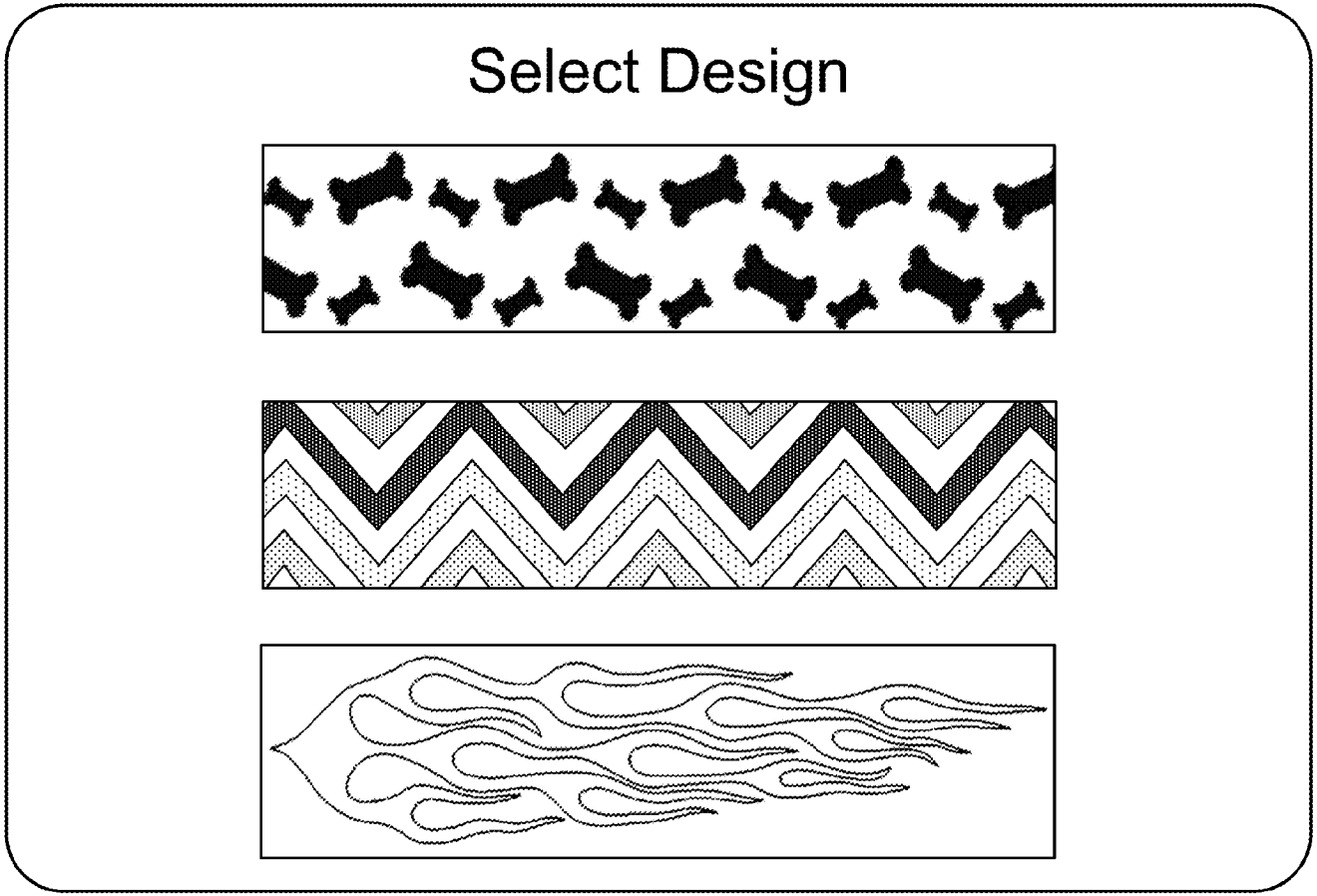
FIG. 14 is an example user interface associated with a sublimation apparatus for customizing a product, consistent with disclosed embodiments.
Figure 15:
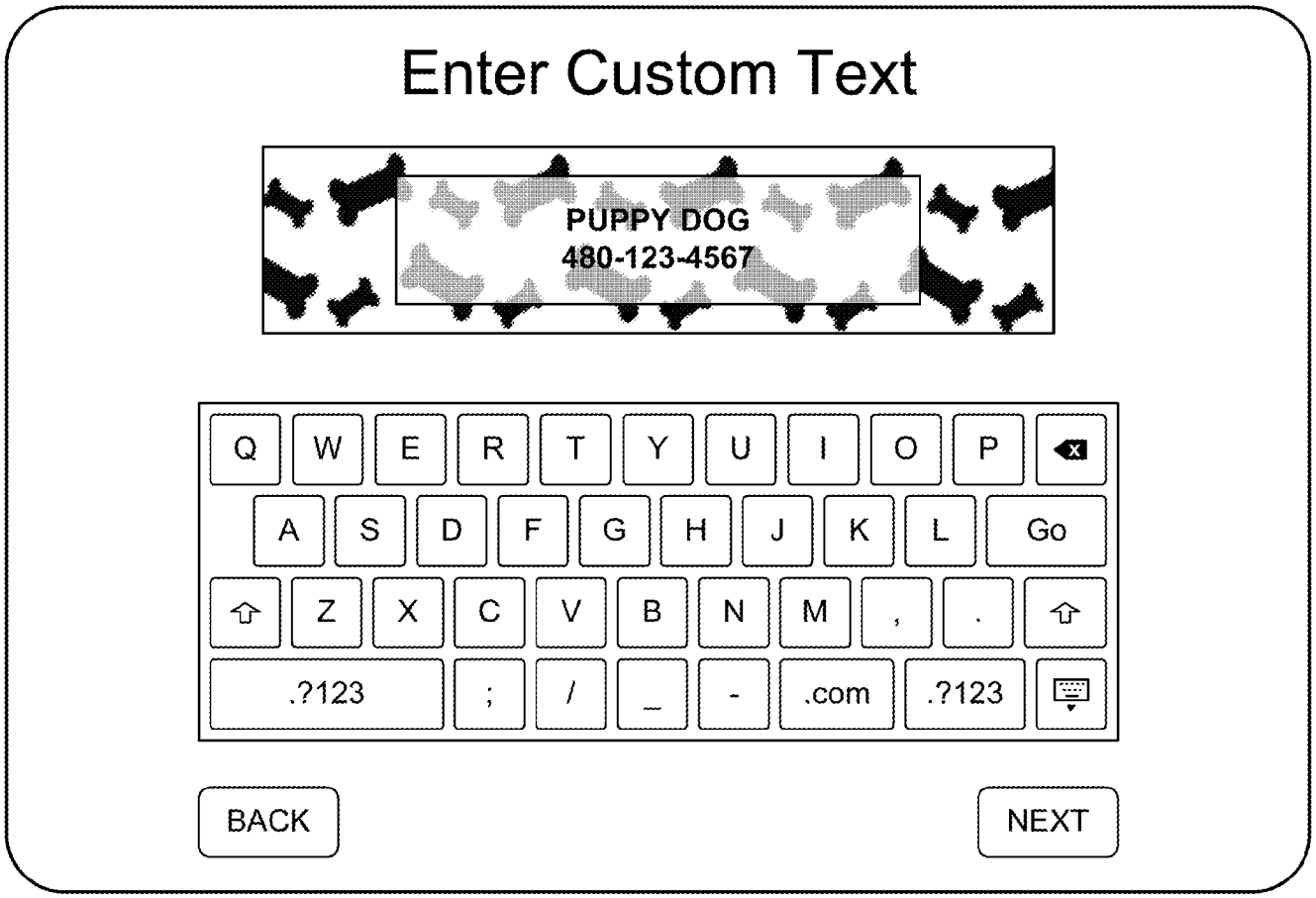
FIG. 15 is an example user interface associated with a sublimation apparatus for customizing a product, consistent with disclosed embodiments.
Figure 16:
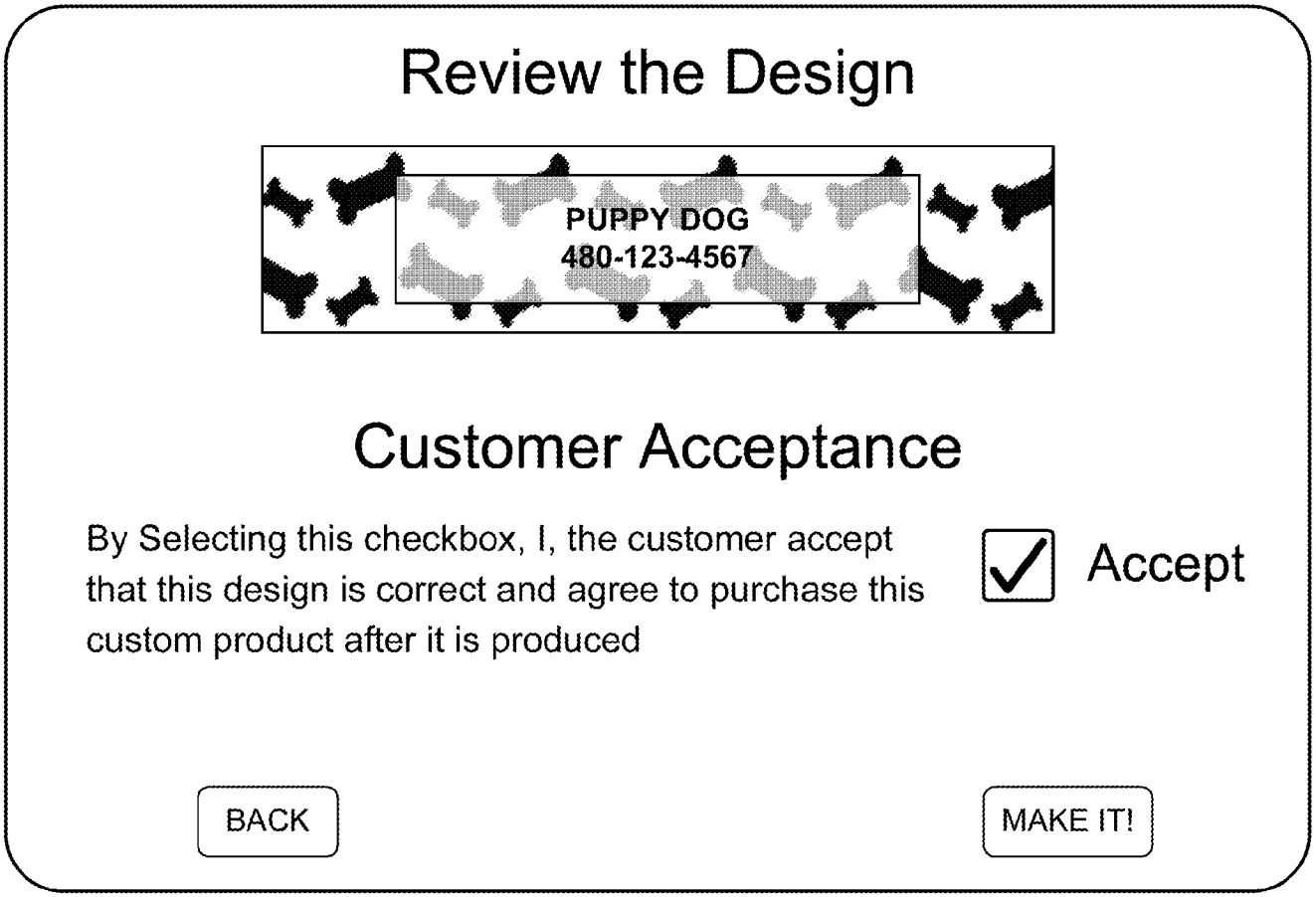
FIG. 16 is an example user interface associated with a sublimation apparatus for customizing a product, consistent with disclosed embodiments.

FIGS. 14-16 are example GUIs that may be configured to walk a user through the process of selecting customized images or text to be sublimated onto a product, such as a product 630. Apparatus 100, via user interface device 106, may provide a variety of different options for customization depending on a number of factors, such as the time of year, location of the apparatus, business agreements, or other such criteria. Images and text available for customization may be stored locally within user interface device 106 as described previously, or may be accessible by user interface device 106 over a wired or wireless network connection.

In FIG. 14, the user has chosen the option of "Collar" as a desired product to sublimate on the GUI of FIG. 13. FIG. 14 is an example GUI that may be configured to assist a user in selecting an artistic design for the collar, and in some embodiments may be displayed when screen mount 108 is rotated to face a consumer 504, such as in FIG. 5A. In alternative embodiments, the GUI of FIG. 14 may be displayed when screen mount 108 is rotated to face an operator 502, such as in FIG. 5B, and the operator 502 may prompt the consumer to indicate the desired design. In the example illustrated in FIG. 14, the user is given the choice of three different designs to select from to sublimate on a pet collar, either directly or via transfer media. More or fewer design options may be available on any particular apparatus 100.

Different embodiments of apparatus 100 may display different options for selection based on the current configuration, popularity, and inventory levels of the particular store, or the particular printing capacities of a printer 122 associated with the particular apparatus 100. For example, one or more of the entity hosting apparatus 100 and the entity responsible for manufacturing and maintaining apparatus 100 may monitor the popularity of particular designs in given locations, and may feature those designs on user interface device 106. Additionally, incentive offers may be presented to a consumer (such as consumer 504) at the time the design is selected. In some embodiments, geographical location of the apparatus 100 may be taken into account in selecting designs. For example, proximity of the apparatus to a university or to a professional sports stadium may lead to apparatus 100 and user interface device 106 being configured to feature logos relating to those entities.

FIG. 15 is an example GUI that may be configured to assist the user in further customizing the product selected in FIGS. 13 and 14. Much in the manner described above, user interface device 106 may be configured to provide input means for a consumer 504 to enter one or more lines of text on top of the design selected via the GUI of FIG. 14. In alternative embodiments, operator 502 may enter the textual information at the direction of consumer 504. In the example of FIG. 15, the name of a pet and a phone number have been entered using the virtual keyboard, and that textual information will be sublimated onto the pet collar in addition to the previously selected artistic design.

FIG. 16 is an example GUI that may be configured to prompt a consumer 504 to affirmatively review, confirm, and accept the final selected design to be sublimated onto a product, such as product 630. User interface device 106 may be configured to permit tactile touchscreen inputs onto the checkbox next to "Accept" in the example of FIG. 16, as well as on either or both of the "Back" and "Make It!" buttons shown in FIG. 16.

Figure 17:
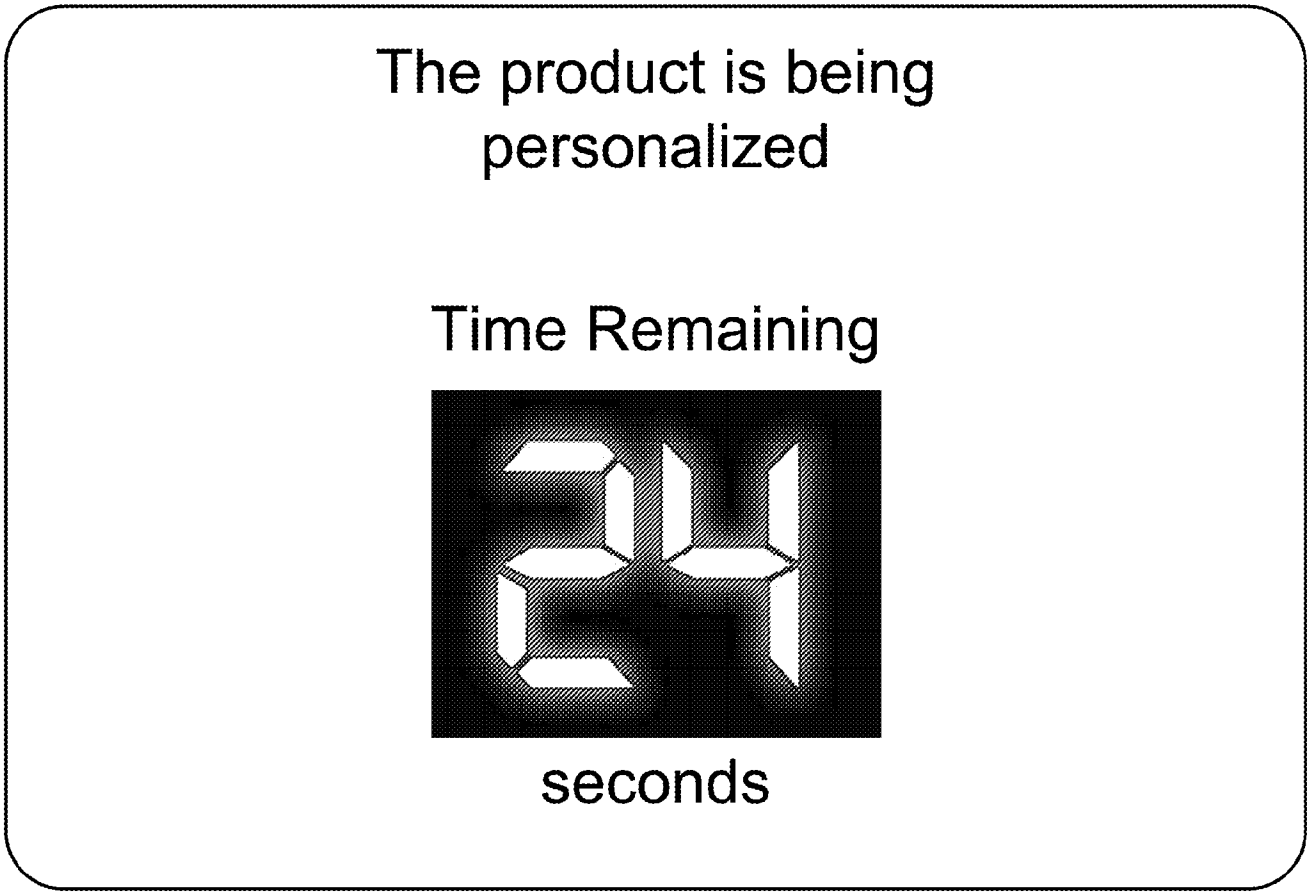
FIG. 17 is an example user interface associated with a sublimation apparatus for providing the operator and consumer with an estimated time remaining for a sublimation task, consistent with disclosed embodiments.
Figure 18:
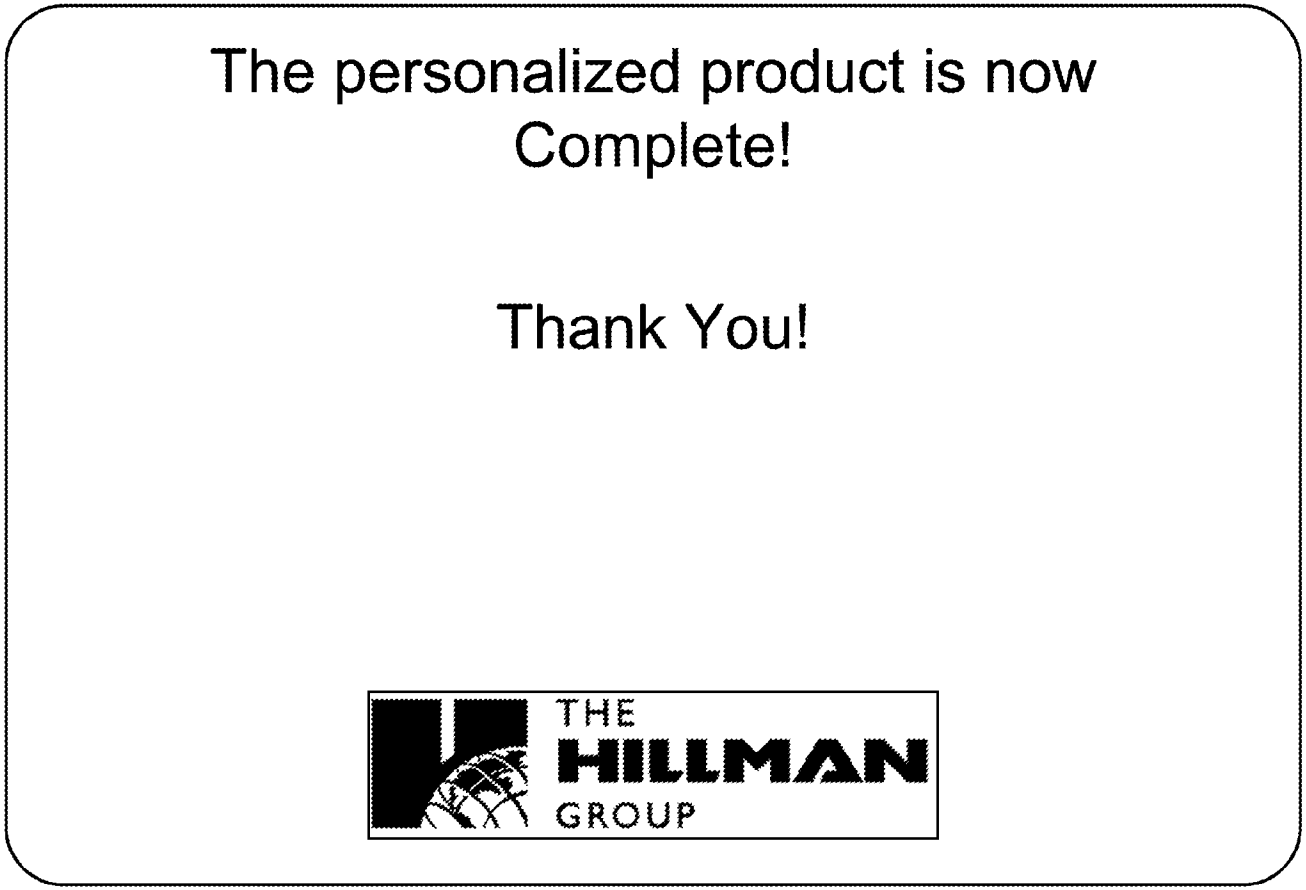
FIG. 18 is an example user interface associated with a sublimation apparatus for indicating that a sublimation task is complete, consistent with disclosed embodiments.

FIGS. 17 and 18 represent examples of GUIs that could be displayed during and/or after the sublimation process described above in association with FIG. 8 and process 800. FIG. 17 illustrates a GUI displayable on user interface device 106 during the sublimation task itself, with a depiction of a clock counting down until the heat and pressure process is completed. Alternatively, the cooling process may also be included in the remaining time shown. FIG. 18 displays a final GUI screen indicating that the product 360 has been completed and is now available to consumer 504. At this point, operator 502 may be permitted to open lower platen 118 and remove product 360. Alternatively, apparatus 100 may automatically push lower platen 118 outwards to a position similar to that shown in FIG. 2A.

As configured, the systems and apparatuses contemplated by the disclosed embodiments allow a broad range of retail establishments to incorporate a safe, adaptable sublimation system for the creation of personalized sublimated products. The semi-automated apparatus can be operated by any retail employee with a minimum amount of training required, and most importantly, can be operated in a safe manner with all potentially hazardous components enclosed in a protective housing. The apparatus takes full advantage of digital technology, allowing all manners of contemporary image acquisition, processing, and social media integration. For retail establishments, the apparatus presents a vast array of exciting new products and market opportunities that appeal to customers, with minimal inputs of labor, training, and inventory management. Deployable in a wide range of configurations due to its modular subsystem design, the apparatus can be individually configured and customized for the needs of a given user or application. Aspects of the apparatus design revolutionize the sublimation process, and allow faster, more productive marketing of sublimated products with less wear on the machine components.

Other embodiments of the invention will be apparent to those skilled in the art from consideration of the specification and practice of the invention disclosed herein. It is intended that the specification and examples be considered as examples only, with a true scope and spirit of the invention being indicated by the following claims.

What is claimed is:

1. An apparatus for sublimating an image on a product, comprising:

a dye sublimation transfer printer configured to print a digital image file representing an image on a sheet of transfer media;

a platen configured to receive and secure the product for sublimation, wherein the platen is configured to receive one or more different types of products into dedicated channels designed to fit the dimensions of each type of product;

at least one light disposed on the platen to assist with alignment of one or more markers printed onto the transfer media;

one or more heating platens configured to engage the transfer media and sublimate the printed image onto one or more sides of the product;

a housing substantially enclosing the dye sublimation transfer printer, platen, light, and one or more heating platens in a manner that prevents a user from contacting the enclosed components; and a user interface device configured to confirm selection of the image to be printed.

2. The apparatus of claim 1, wherein the platen further comprises one or more clamps configured to secure at least a portion of the transfer media into contact with the platen.

3. The apparatus of claim 1, wherein the platen further comprises one or more clamps configured to secure at least a portion of the product into contact with the platen.

4. The apparatus of claim 1, further comprising:

a reversible motor configured to translate the platen to various positions within the apparatus; and a controller configured to control the motion of the motor.

5. The apparatus of claim 4, wherein the reversible motor is configured by the controller to translate the platen from a position within the housing to a position outside of the housing for loading or removal of the product.

6. The apparatus of claim 1, wherein the apparatus further comprises:

a lever arm assembly configured to transfer pressing force to the one or more heating platens;

a reversible motor configured to generate the pressing force and operate the lever arm assembly; and a controller configured to control the motion of the motor.

7. The apparatus of claim 6, wherein the lever arm assembly and the one or more heating platens are coupled together by at least one or more springs with a known spring constant.

8. The apparatus of claim 1, wherein the one or more heating platens sublimate the printed image onto one or more sides of the selected product in a single thermal cycle, the thermal cycle including a predetermined temperature, pressure, and duration.

9. The apparatus of claim 8, further comprising a controller including one or more processors, wherein the controller is configured to automatically determine one or more of the temperature, pressure, or duration of the thermal cycle based upon one or more properties of the product to be sublimated.

10. The apparatus of claim 9, wherein the properties of the product to be sublimated are accessed automatically from a memory or database associated with the user interface device.

11. The apparatus of claim 9, wherein the properties of the product to be sublimated are determined by the apparatus by reading an indicia printed on the product containing the properties.

* * * * *